US009403641B1

(12) United States Patent
Ghibaudo

(10) Patent No.: US 9,403,641 B1
(45) Date of Patent: Aug. 2, 2016

(54) SIDE LOADER ARM FOR REFUSE COLLECTION VEHICLE

(71) Applicant: Amrep, Inc., Ontario (CA)

(72) Inventor: Gabriel A. Ghibaudo, Ontario (CA)

(73) Assignee: Amrep, Inc., Ontario, CA (US)

( * ) Notice: Subject to any disclaimer, the term of this patent is extended or adjusted under 35 U.S.C. 154(b) by 240 days.

(21) Appl. No.: 14/244,793

(22) Filed: Apr. 3, 2014

Related U.S. Application Data

(60) Provisional application No. 61/909,814, filed on Nov. 27, 2013, provisional application No. 61/921,295, filed on Dec. 27, 2013.

(51) Int. Cl.
*B65F 3/02* (2006.01)

(52) U.S. Cl.
CPC ..... *B65F 3/02* (2013.01); *B65F 2003/023* (2013.01); *B65F 2003/025* (2013.01)

(58) Field of Classification Search
CPC ..... B65F 3/08; B65F 3/0046; B65F 3/02; B65F 2003/0276; B65F 2003/025; B65F 2003/023
USPC ..... 414/408, 409, 406, 422, 425, 758, 782
See application file for complete search history.

(56) References Cited

U.S. PATENT DOCUMENTS

| | | | | |
|---|---|---|---|---|
| 2,592,324 | A * | 4/1952 | Oliver | B65F 3/08 414/409 |
| 3,087,637 | A | 4/1963 | Fox | |
| 3,136,436 | A * | 6/1964 | Erlinder | B60P 1/48 414/409 |
| 3,910,433 | A * | 10/1975 | Love | B60P 1/50 414/420 |
| 4,057,156 | A | 11/1977 | Thompson et al. | |
| 4,219,298 | A * | 8/1980 | Stragier | B65F 3/08 414/409 |
| 4,313,707 | A | 2/1982 | Bingman et al. | |
| 5,007,786 | A | 4/1991 | Bingman | |
| 5,702,225 | A | 12/1997 | Ghibaudo | |
| 6,071,058 | A | 6/2000 | Tetz et al. | |
| 6,491,489 | B1 * | 12/2002 | Stragier | B65F 3/046 414/409 |
| 7,559,735 | B2 | 7/2009 | Pruteanu et al. | |

FOREIGN PATENT DOCUMENTS

| | | | |
|---|---|---|---|
| DE | 102006032206 | A1 | 1/2008 |
| EP | 1142803 | A1 | 10/2001 |
| EP | 1451848 | A1 | 8/2004 |
| WO | 2006074396 | A1 | 7/2006 |

* cited by examiner

*Primary Examiner* — Saul Rodriguez
*Assistant Examiner* — Mark Hageman
(74) *Attorney, Agent, or Firm* — Stetina Brunda Garred & Brucker; Lowell Anderson

(57) ABSTRACT

A side loader for a refuse vehicle has a laterally extendable first arm with an upper carriage connected to a gripper to releasably engage refuse containers. A second curved arm has a first position abutting the top end of the first arm so the upper carriage can reciprocate along the first and second arms. The second arm has a second, rotated position which dumps the refuse container into the vehicle. A drive chain connected to the upper carriage passes over a return roller which changes the direction of the chain before it is connected to the vehicle. A lower carriage reciprocates along the lower side of the first arm and holds two oppositely directed, hydraulic pistons. One piston moves the lower carriage relative to the vehicle and the other moves the return roller to alter the effective chain length and move the upper carriage faster than the lower carriage.

35 Claims, 15 Drawing Sheets

SIDE LOADER ARM FOR REFUSE COLLECTION VEHICLE

CROSS-REFERENCE TO RELATED APPLICATIONS

The application claims the benefit under 35 U.S.C. §119(e) to Provisional Patent Application No. 61/909,814 filed Nov. 27, 2013, and Provisional Patent Application No. 61/921,295 filed Dec. 27, 2013 the entire contents of which are incorporated herein by reference.

STATEMENT RE: FEDERALLY SPONSORED RESEARCH/DEVELOPMENT

Not Applicable

BACKGROUND

Refuse collection vehicles can pick up and empty refuse containers from the front of the vehicle or from the side. Loading from the front of the vehicle as in U.S. Pat. No. 6,071,058 requires sufficient access so the front of the large refuse vehicle can approach the refuse container and such access is not possible in narrow alleys. Also, front loading lifts the refuse container over the vehicle cab and operator posing inherent risks if the container or its contents fall onto the cab during operation. In contrast, side-loading refuse vehicles need only drive alongside a refuse container and the container is lifted over the side of the vehicle rather than over the cab so there are access and safety advantages. Unfortunately, a side loading refuse vehicle cannot always get as close to the refuse container for ease of pick-up compared to a front loading vehicles. Thus, side loading refuse vehicles usually have mechanisms to extend from the vehicle and engage the refuse container and that increases complexity.

Side loading mechanisms exist that use articulated arms as in EP1142803. But the articulation joints are subject to wear and impart lateral movement to the assembly holding the refuse container when the arm is in the extended position.

Current mechanisms for side loading refuse vehicles are illustrated by U.S. Pat. No. 5,702,225 to Ghibaudo, which has a lateral rail extending and retracting the bottom of an arm with a carriage reciprocating along the length of the arm to pick up and empty trash receptacles. A pair of opposing grippers is connected to the carriage and engages a full refuse container resting on the ground. The grippers and refuse container move with a carriage along the length of the arm to lift the container from ground level to the top of the vehicle's refuse compartment. The top of the single-piece arm is curved so the arm resembles an inverted J shape, referred to as a candy cane shape. As the carriage moves along the curved portion, which extends downward, the container is inverted so as to empty the contents into the refuse compartment at the same location on the vehicle. As the carriage moves to the opposing end of the arm by the ground, the empty container is set back on the ground where the grippers release it whereupon the arm is retracted against the vehicle. The top of the one-piece arm was pivotally mounted at the top so the entire arm rotates about that top pivot, with the tip pivot mounted to move vertically relative to the vehicle.

While this is an improvement on prior side loading refuse vehicles. The movement of the arm and carriage rely on a series of pulleys, gears and motors which too often wear, break, or for various other reasons become misaligned sufficiently to require repair. Further, the movement of the carriage, grippers and refuse container and parts around the curved end of the arm caused the container to undergo a rapid acceleration and rotation which comes to an abrupt stop when the carriage hits a stop and that jars the single-piece arm mechanism, contributing to wear, misalignment and breakage. There is thus a need for an improved side loader for refuse vehicles.

BRIEF SUMMARY

A side loader for a refuse vehicle is provided which as an arm having upper tracks along which a wheeled upper carriage may move in order to carry a conventional gripper and leveler assembly mounted to the upper carriage, along with a refuse container releasably held by the gripper. The arm has a lower and upper arm portion, with the lower arm portion being straight and the upper arm portion being curved and pivotally mounted to rotate about a generally horizontal axis that is perpendicular to the path of travel along the arm, with the upper tracks extending along both the upper and lower portions.

The lower arm is pivotally mounted at opposing ends, with the lower end of the lower arm pivotally mounted to a laterally extending rail that moves the lower end toward and away from the vehicle during use. The upper end of the lower arm is pivotally mounted to a support post mounted to the vehicle and constrained to move in a generally vertical direction so that as the lower end of the lower arm moves away from or toward the vehicle the upper end will rise or fall as needed to allow lateral, generally horizontal movement of the lower end. Telescoping posts are believed suitable for the vertical motion. The lower arm portion, the laterally extending rail and the vertical support posts on the vehicle form three sides of a triangle, with the generally vertical support posts allowing the vertical length of the triangle to change as the length of the laterally extending rail changes and as the included angles of the triangle change. Pivotally mounting the lower arm at the top and bottom and allowing vertical movement of the top pivot mount allows the lower end of the lower arm portion to remain generally horizontal as the arm moves extends from the vehicle, making it easier to position the grippers to grab and lift refuse containers, and making it easier to set the containers down on the ground at a desired location, after they are emptied.

The curved, upper arm preferably has two straight end segments joined by a curved middle section of 10-20 degrees arc, so the distal end of the curved portion still remains upwardly inclined when the lower arm is extended for pick-up, allowing the weight of the wheeled upper carriage, gripper and refuse container to urge them to roll back down the upper tracks toward the ground. The distal end of the upper arm has a motion limit stop and a sensor such that when the wheeled upper carriage reaches the distal end of the curved upper arm, the upper arm is rotated about a pivot axis to dump the contents of the refuse container held by the upper tracks of the upper arm portion.

Extendable hydraulic pistons are believed suitable for the dumping rotation and retraction of the pistons may return the carriage, gripper and (empty) refuse container to the original position with aligned upper tracks so the carriage and connected parts may roll toward the ground to deposit the refuse container and pick up another one. This construction and operation allows a controlled emptying of the refuse containers. Because the carriage and connected parts need not be driven against the end of the upper arm by gravity as occurs when the end of the track curves downward as in prior art candy-cane shaped-arms, the impact forces, wear and misalignment of parts is reduced. The need to control the speed of the carriage toward the end of the arm as in the prior art where the candy cane curved downward, is also reduced or eliminated. Moreover, the rotation of the upper arm portion carriage, grippers and refuse container in order to dump the full refuse container, and then rotate the upper arm portion to align it with the lower arm portion to reposition the empty container for return to the ground is believed to be faster than the prior art, allowing a faster cycle time.

The upper carriage and associated parts may be driven by various mechanisms, including endless chain drives with a sprocket and optional gearing of the motor and drive chain assembly. Preferably though, a hydraulic drive is used in which two hydraulic carriage pistons are mounted to a lower carriage so the carriage pistons extend in opposing directions along the length of the lower arm portion. The lower carriage moves on a lower track beneath the upper track and preferably separated therefrom by a divider, with the lower track extending most of the length of the lower arm portion. One carriage drive piston fastens to the vehicle or the upper end of the arm to move the lower carriage toward and away from that upper end of the arm. The other carriage drive piston moves a lower return roller mounted to a wheeled shaft in order to move that wheeled roller along the lower track toward and away from the bottom end of the lower arm. A flexible, elongated member such as a wire rope, belt or preferably a chain has a first end fastened to the vehicle or the upper end of the lower arm so it doesn't move and has the other end fastened to the upper carriage, preferably at its upper end. The chain passes the lower carriage, reverses direction at the lower return roller to pass on the other side of the lower carriage before passing over an upper return roller that is straddled by the opposing tracks of the upper, curved arm portion, and then extends along the upper side of the lower arm section to connect to the upper carriage. As the carriage chain drive pistons extend the effective length of the chain is shortened and the upper carriage, gripper and refuse container move from the ground to the dump position. The chain wraps around at least one sprocket connected to the carriage pistons so that extension and contraction of the pistons move the upper carriage, gripper and refuse container. As the chain drive pistons retract the effective length of the chain lengthens and the upper carriage and associated parts roll down the arms toward the ground for unloading and picking up the next refuse container. The hydraulic pistons extending in opposing directions cause the chain length to change more rapidly than even a geared rotary motor achieves and is believed to be much faster than prior art drives using electric motors. Further, the extension of the hydraulic drive pistons and the chain length may be selected to suit the specific needs and more accurately control the position of the upper carriage on the upper and lower arms.

In more detail, a side loader is provided for emptying refuse containers into a refuse collection vehicle. The side loader has an upper carriage that has wheels. A gripper mechanism has opposing grippers that are configured to open and close to release and engage a refuse container. The gripper mechanism is connected to and moves with the upper carriage. The side loader has a first arm with opposing, top and bottom ends. A pair of spaced apart upper tracks extends between the top and bottom ends of the arm. The upper tracks are configured to guide the wheels of the upper carriage as the carriage reciprocates along the upper tracks of the first arm. The first arm is pivotally connected to the vehicle at the top end of the first arm to rotate about a first arm pivot axis. The first arm is pivotally connected to a laterally extending rail so the bottom end of the first arm may move away from and toward the vehicle. The side loader has a second arm that in turn has opposing lower and upper or distal ends and also has a pair of spaced apart upper tracks extending therebetween. The second arm has a curved portion and is pivotally mounted to the vehicle to rotate about a second arm pivot axis between a first position and second position. In the first position the lower end of the second arm is adjacent the top end of the first arm and the upper tracks on the first and second arms are sufficiently aligned and close together so the upper carriage can roll onto the upper tracks of the second arm. In the second position the second arm has rotated about the second arm pivot axis enough to dump the contents of a refuse container held by the grippers during use of the side loader.

In further variations of this side loader, the second arm is preferably curved. In particular, the distal end of the second arm is preferably higher than the lower end of the second arm when the second arm is in the first position. The upper rail on the second arm may have a straight portion adjacent the lower end and at the distal end of the second arm, with a curved portion in between. The curved portion preferably subtends an arc that is not large enough to incline the distal end downward. The distal end of the second arm is higher than the lower end of the second arm when the second arm is in the first position.

Additionally, the side loader preferably has a three bar linkage rotating the second arm between the first and second positions. The first arm may pivot about a pair of side supports adjacent the upper end of the first arm and the second arm may be pivotally connected to those side supports—directly or indirectly through a side plate connected to each side supports. The side loader has drive means configured to reciprocate the upper carriage along the first and second arms.

The side loader advantageously has a divider extending between the opposing upper rails on the first arm and extending along a majority of a length of the first arm. The divider may connect to a lower side of the upper rails on the first arm and have a center portion between the upper rails that extends outward beyond that lower side of the upper rails. The divider may separate the upper carriage and a lower carriage and associated lower rails, described below.

The side loader preferably has a lower carriage having wheels and a pair of spaced apart, lower tracks extending a majority of the length of the first arm and located on a bottom side of the first arm. The lower tracks are configured to guide the wheels of the lower carriage as the carriage reciprocates along the lower tracks of the first arm. First and second extendable drive pistons are connected to the lower carriage and aligned to extend in opposing directions along the length of the first arm. The first drive piston has an extendable end that is connected to a positionable shaft configured to move along a second length of the lower tracks as the second piston extends and retracts. The second drive piston has an extendable end that is pivotably connected to the vehicle during use to reciprocate the carriage along a first length of the lower tracks as the first drive piston extends and retracts. The pistons cooperate with an elongated drive member to move the first and second carriages.

A flexible, elongated drive member has a first end connected to the upper carriage and a second end connected to the vehicle, directly or indirectly as being connected to the side supports or the side plates that are connected to the side supports. The elongated drive member passes over at least a first rotating part at the top end of the second arm which reverses the direction of the elongated drive member a second return rotating part on the positionable shaft to also reverse the direction of the elongated drive member so that extension and retraction of the first and second chain drive pistons a total distance X causes the second return rotating part to move a total distance X and the upper carriage to move a distance greater than X.

The first and second drive pistons preferably comprise hydraulic pistons. The positionable shaft may comprise a shaft having wheels configured to reciprocate along the lower tracks, with the first length extends along a top portion of the first arm and the second length extends along a bottom portion of the first arm. The elongated drive member preferably comprises a chain.

The drive mechanism is preferably located on the opposite side of the outwardly extending portion of the divider as is the first carriage. In this arrangement the first and second extendable drive pistons are connected to the lower carriage and aligned to extend in opposing directions along the length of the first arm, with the second drive piston having an extendable end that is connected to a positionable shaft having wheels configured to move along a second length of the lower tracks as the second piston extends and retracts. The first drive piston has an extendable end that is pivotably connected to the vehicle during use to reciprocate the carriage along a first length of the lower tracks as the first drive piston extends and retracts and a portion of the drive pistons are located within a bottom side of the outwardly extending portion of the divider. In this arrangement the elongated drive member has a first end connected to the upper carriage and a second end connected to the vehicle with the elongated drive member passing over a first rotating part at the top end of the first arm and a return rotating part on the second arm which reverses the direction of the elongated member. The elongated drive member passes over a second return rotating part on the positionable shaft which again reverses the direction of the elongated member and so that extension and retraction of the first and second chain drive pistons to move the lower carriage a distance X causes the upper carriage to move a distance greater than X.

There is also advantageously provided a mechanism for moving a gripper mechanism reciprocating along an arm connected to a refuse collection vehicle. The gripper mechanism has arms configured to releasably grip a refuse container. The arm has a lower end extending toward and away from the vehicle during use. An upper end of the arm is sufficiently above a portion of the vehicle to allow the refuse container to be dumped into the vehicle. The mechanism for moving the gripper includes a first gripper carriage to which the gripper mechanism is connected. The first carriage is configured to reciprocate along a length of the arm sufficient to enable the gripper to pick up, dump and set down refuse containers. A second piston carriage is mounted to reciprocate along a length of the arm with the second, piston carriage having first and second carriage pistons each aligned to extend along a length of the arm but in opposing directions. The first carriage piston has a distal end connected to a first rotating part mounted to move along a length of the arm while the second carriage piston has a distal end connected to the vehicle at a fixed location. The flexible, elongated drive member has a first end connected to the first gripper carriage and a second end connected to the vehicle at a fixed location with the chain extending from the first gripper carriage, over a second rotating part at the upper end of the arm where the chain reverses directions and extends past the piston carriage and around the first movable part where the chain reverses direction and extends past the piston carriage to the second end of the elongated drive member, such that a change in length of one carriage piston a distance X moves the first gripper carriage a distance X and a change in length of both carriage pistons a distance X moves the first gripper carriage a distance 2X. The first and second carriages are preferably located entirely on opposing sides of the arm. And move along the arm in opposing directions. The arm may have an upper and lower segment with the upper segment rotatablely mounted to rotate about a generally horizontal axis to rotate the first gripper carriage to a dump position.

There is also provided a method for moving a gripper mechanism along an arm connected to a refuse collection vehicle where the gripper mechanism has arms configured to releasably grip a refuse container. The arm has a lower end extending toward and away from the vehicle during use and has an upper end sufficiently above a portion of the vehicle to allow the refuse container to be dumped into the vehicle. The method comprising the steps of moving a first carriage to which a gripper is mounted, along the arm in a first direction and moving a second carriage along the arm in a second direction opposite to the first direction using first and second extendable pistons. The first piston has one end connected to the vehicle to move the second carriage along the arm as the first piston extends and retracts. The second piston is connected to a first rotating part around which an elongated flexible member extends to reverse the direction of the flexible member and to also change the distance between the first rotating part and the second carriage as the second carriage piston extends and retracts. The elongated member extends around a second rotating part to reverse the direction of the elongated member before that elongated member connects to the first carriage with the elongated member having a second end connected to the vehicle. Thus, extending the pistons moves the lower carriage a distance X and moves the upper carriage a distance greater than X and preferably a distance 2X.

BRIEF DESCRIPTION OF THE DRAWINGS

These and other features and advantages of the invention will become more apparent in light of the following discussion and drawings, in which like numbers refer to like parts throughout, and in which.

DETAILED DESCRIPTION

Figure 1:
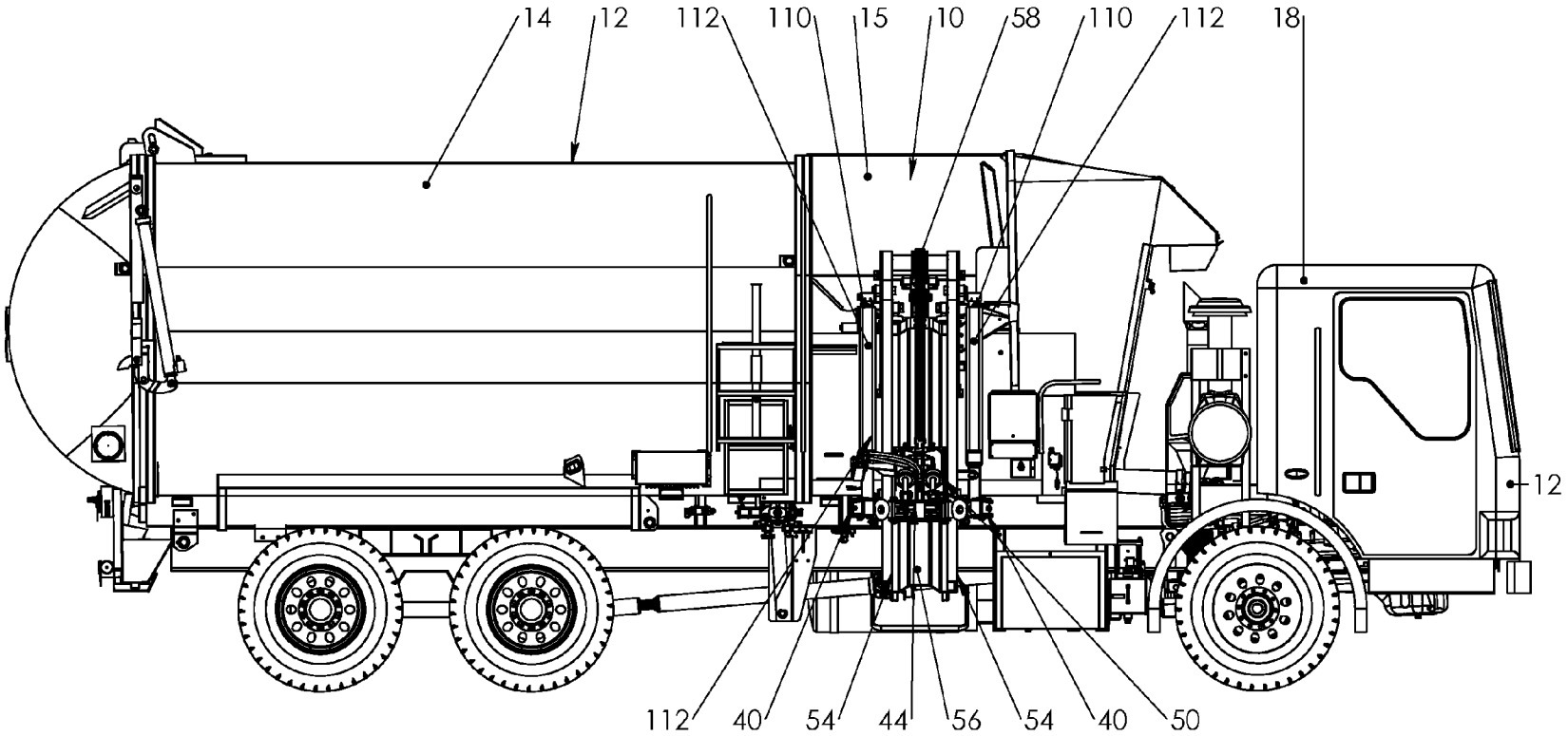
FIG. 1 side plan view of a refuse truck having a side loader with a curved, upper end and a gripper in a stowed configuration.
Figure 2:
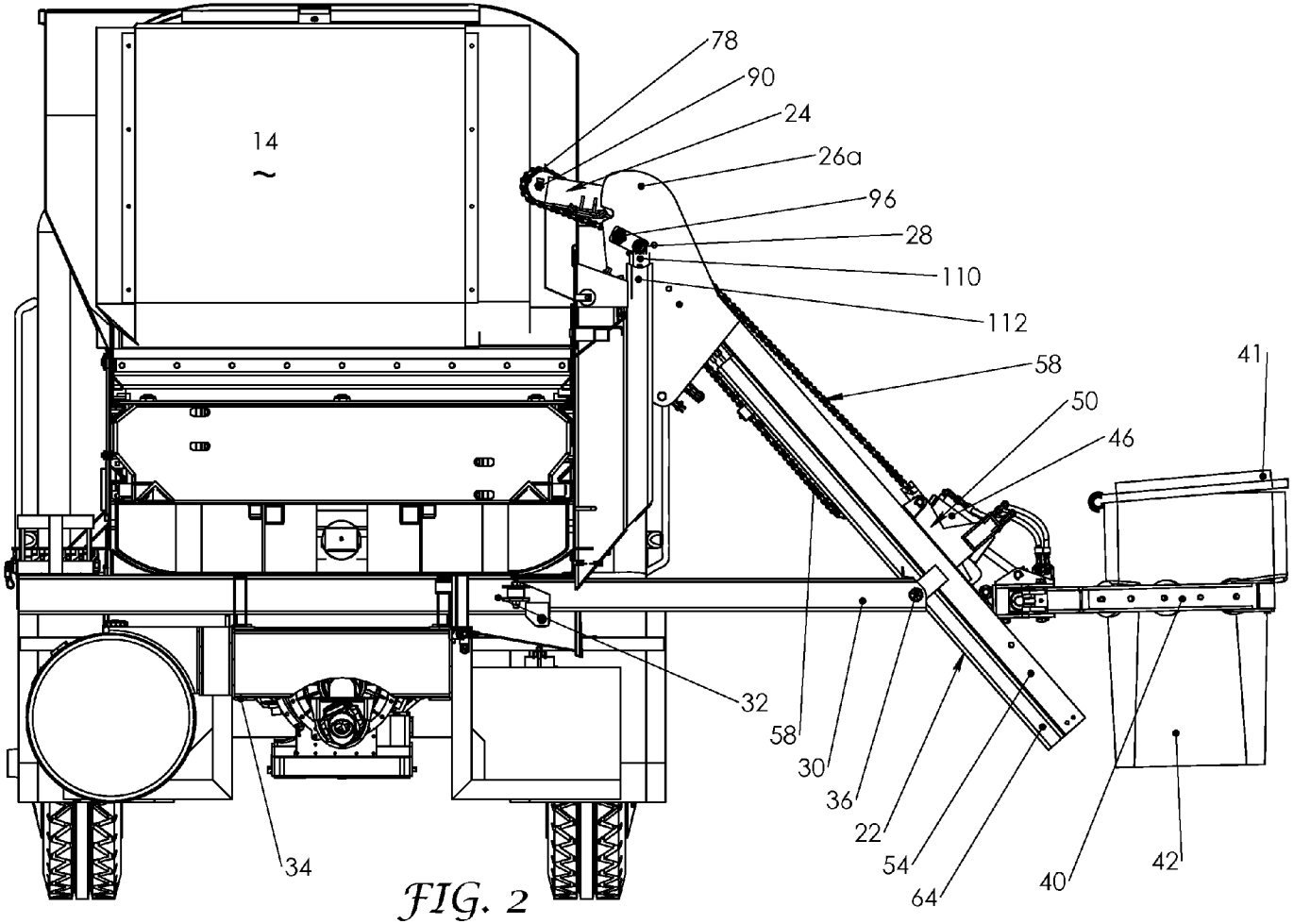
FIG. 2 is a side view of a portion of the vehicle and side loader of FIG. 1, in an extended position with the gripper engaging a refuse container on the ground.
Figure 3:
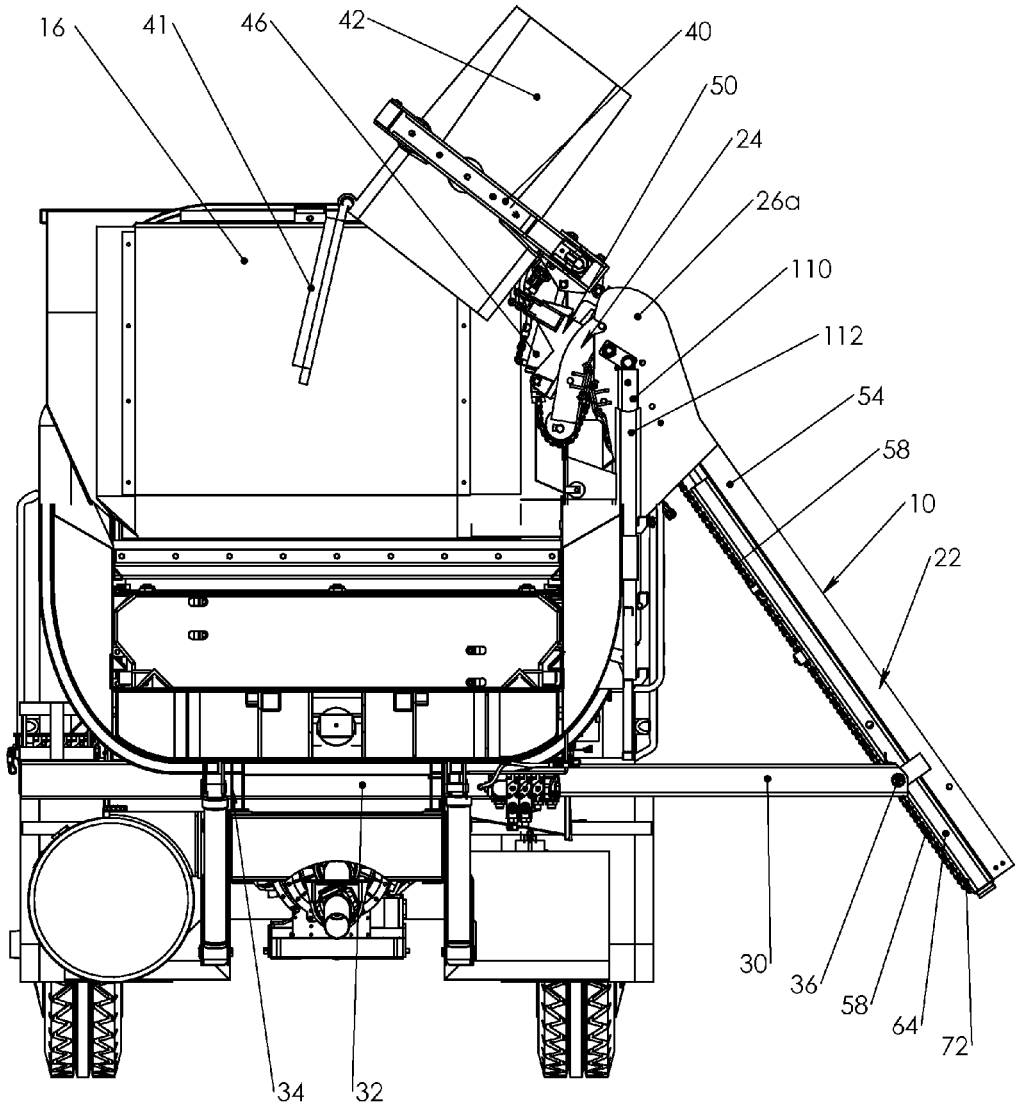
FIG. 3 is another side view of the side loader of FIG. 2 with the gripper and refuse container being emptied into the vehicle and with extendable dump pistons being shown in an extended position.
Figure 4:
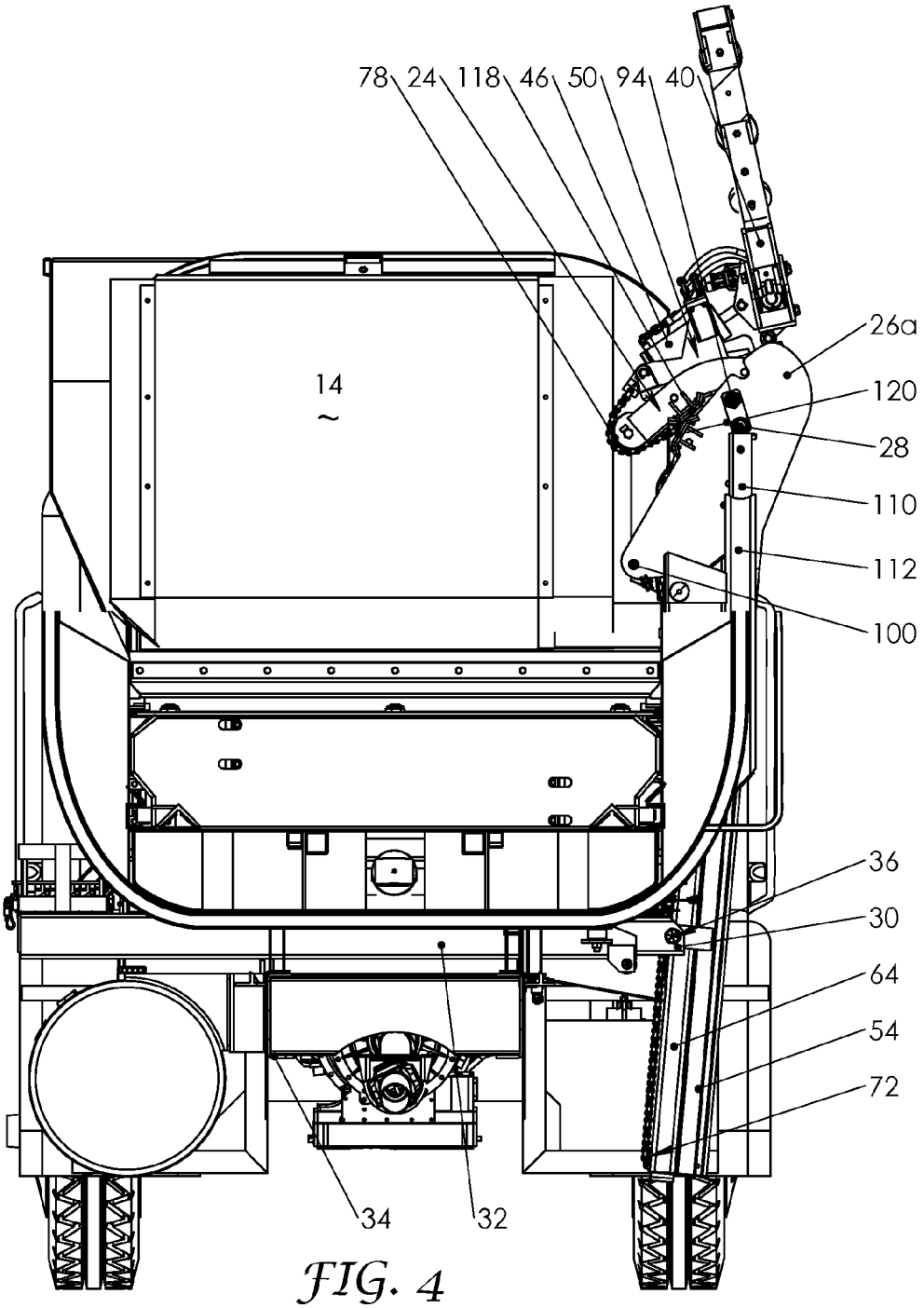
FIG. 4 is another side view of the side loader of FIG. 2 showing several parts in broken lines and in a stowed configuration as in FIG. 1 and an arm in an intermediate rotated position.

Referring to FIGS. 1-2, a side loader 10 is mounted to the side of refuse collection vehicle 12 which has a long hollow body 14 into which refuse is compacted as is known in the art. The front end of the body 14 has an upwardly opening hopper section 15 into which a refuse container is dumped. A cab 18 is at the front of the vehicle for steerage of the vehicle and operative control of the side loader 10, although additional or redundant controls may be placed on the side of the vehicle 12 adjacent the side loader. As used herein the relative terms above, below, upper, lower, top, bottom refer to the relative directions or positions along a vertical axis perpendicular to the ground surface on which the vehicle 10 rests. The lateral direction refers to a direction more parallel to the ground and relative to the vehicle 10. The relative directions front, back, forward and backward refer to the relative position or direction along longitudinal axis 21 of the vehicle 12 with front being toward the cab 18 and parallel to the ground and with back or rear being in the opposite direction.

Referring to FIGS. 2-7, the side loader 10 may be viewed as a lift arm 20 having two separable parts, a first, lower arm portion 22 that is preferably straight, and a second, upper, rotating portion 24 that is preferably curved or contains a curved part, that is rotatably mounted as described later, and that preferably has a distal end that is not extending downward a distance sufficient to cause the carriage to fall downward with gravity. The second, upper rotating portion 24 rotates between or from a first position aligned with the first, lower arm portion 22 to a second, dump position as described later. The upper end of first or lower arm portion 22 is rotatably mounted at pivot joints 28, with a pivot joint 28*a*, 28*b* being located on each of respective side supports 26*a*, 26*b* which in turn are located adjacent the body of the vehicle 12 near the opening to the hopper 16. The side supports 26*a*, 26*b* are preferably parallel to each other and more preferably take the form of sturdy plates sized or reinforced sufficiently to carry the loads to which they are subjected. The side plates 26 are preferably orthogonal to longitudinal axis 21. The side supports 26 pivot about an axis through pivot joints 28 (28*a*, 28*b*). As described later this pivot axis preferably moves vertically to allow the lower end of the lower arm 20 to remain generally horizontal as the arm 20 extends away from and toward the vehicle 12.

The lower end of the first arm portion 22 is pivotally supported along a rotational axis through pin and bracket assemblies forming a pivot joint 36 on the outer ends of each of two extendable horizontal support rails 30. Only one of the pivot joints 36 is visible in FIG. 2. The outer support rails 30 slide in parallel relationship on rollers (not shown) journaled thereto inside of corresponding frame elements in the form of hollow box beams 32. The box beams 32 are welded to the underside of the hopper section 16 and are connected to a pair of longitudinal frame members 34 of the refuse collection vehicle 12. As needed, bumpers or shock absorbing materials may be interposed between the box beams 32 and the fame members 34. The frames 34 extend forward and rearward along the body of the vehicle 12 while the box beams 34 extend transversely or laterally beneath the hopper section 16 so the outer support rails 30 extend from and retract into the side of the vehicle body 14 of the refuse collection vehicle 12. Each box beam 32 receives a corresponding one of the outer support rails 32 in telescoping fashion. Thus, the first arm portion 22 is pivotally mounted at its upper and lower ends so the upper end rotates about the axis defined by pivots 28 while the lower end moves laterally toward and away from the vehicle body 14 as the support rails 30 extend or retract, and rotates about the axis defined by lower pivots 36. The axes of rotation defined by pivots 28, 36 are generally horizontal in the depicted embodiment, and parallel to longitudinal axis 21.

A lateral extension hydraulic piston 38 (FIGS. 7 & 12) has a first end mounted to the vehicle 12 and its distal end connected to the extendable support rails 30 so that extension and retraction of the lateral extension piston 38 extends and retracts the support rails 30. The connection with the lateral extension piston 38 is a rotating connection.

Figure 7:
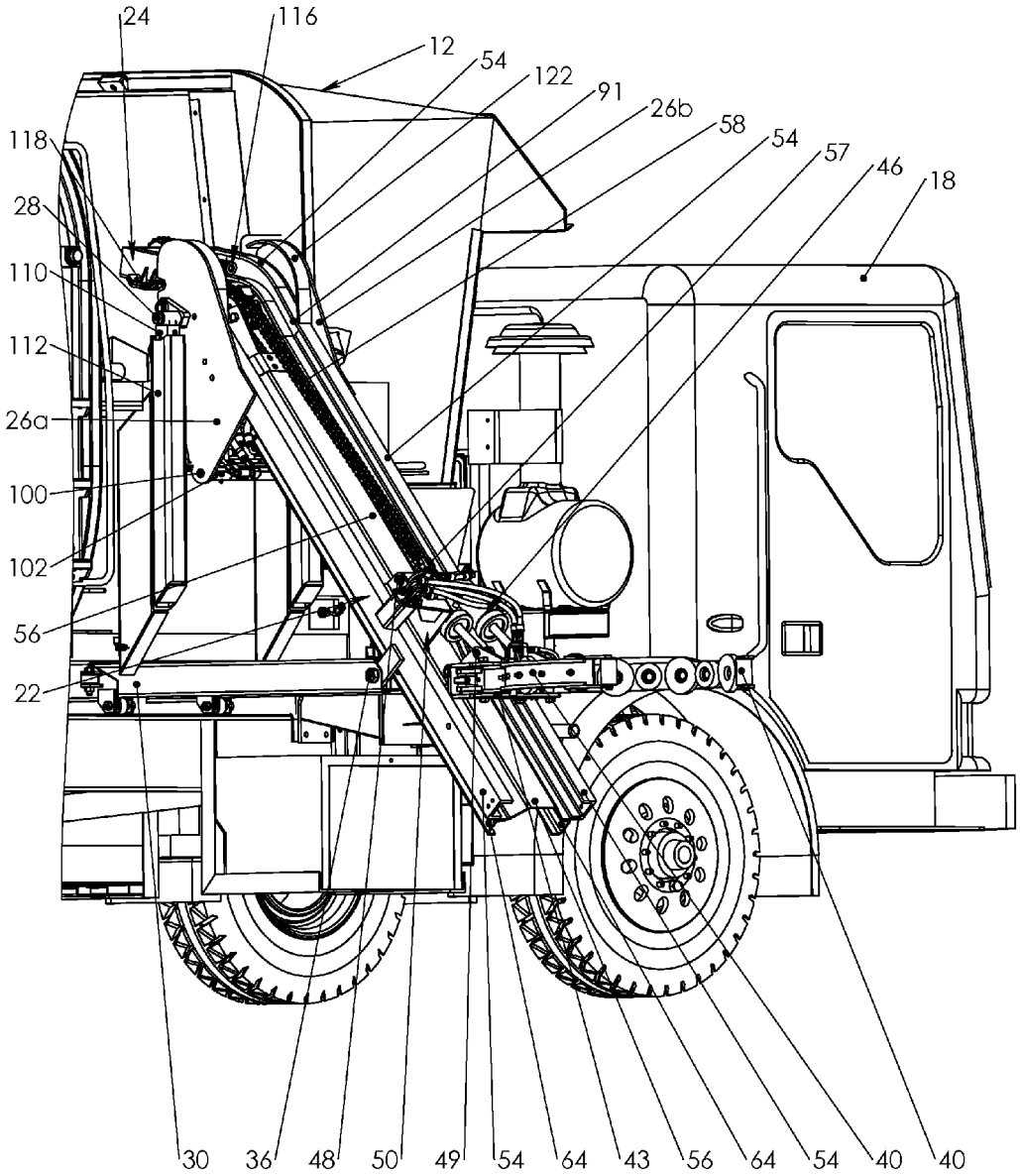
FIG. 7 is a partial perspective view of a side loader in an extended position with a carriage and gripper midway along the length of a lower portion of the side loader.

A pair of hydraulically actuated opposing grippers 40 is provided for engaging and holding a refuse container 42 having an optional lid 41, shown in FIG. 2 as a frusto-conical shaped trash container 42. Only one of the grippers 40 is visible in FIG. 2. Each gripper 40 extends from a base 43 which is pivotally mounted to an upper carriage 50 so the base and thus the grippers rotate about an axis parallel to longitudinal axis 21 in order to position the grippers parallel to the ground to pick up refuse containers 42. Also, the base of each gripper 40 is pivotally mounted to the base 43 so as to rotate about an axis that is vertical in FIG. 2 but which will actually vary if the base 43 rotates to tilt the grippers 40 relative to the ground. A hydraulic gripper piston 44 (FIG. 1) has a distal end connected along a length of the gripper 40, with the base of the piston connected to upper carriage 50 (FIG. 1) where the grippers are pivotally mounted, so that extending and retracting the gripper piston 44 closes and opens the grippers 40 to grab and release containers 42. A separate gripper piston 44 is provided for each gripper. Such grippers and their actuating mechanisms are known in the art. A hydraulic actuated, gripper leveling piston 46 has a base end pivotally mounted to upper carriage 50 at pivot 48 (FIG. 7) and an opposing end connected at pivot 49 (FIG. 4) on the base 43 of the grippers 40 so as to orientate the grippers relative to the ground and to the upper carriage 50. Preferably two leveling pistons 46 are used as seen in FIG. 7. The leveling pistons 46 are in fluid communication with the pistons actuating the lateral support rails 30 so that if the later support rails 30 retract or extend as the upper carriage 50 is traversing the lower arm portion 22, the leveling cylinders 46 maintain the refuse container 42 in an sufficiently upright position to avoid dumping the contents prematurely. Likewise, the control of hydraulic cylinders moving the lateral rails 30 and the leveling cylinders 46 is such that the orientation of the refuse container 42 is in a desire orientation as the upper arm portion 24 rotates to the dump position. The leveling pistons 46 and mechanisms for operating grippers 40 are known in the art as are control mechanisms for actuating the grippers 40 and maintaining the grippers 40 at desired orientations, and these aspects not described in detail. Likewise the connection of the grippers 40 to the carriage 50 is known in the art and is not described in detail herein.

The upper carriage 50 reciprocates along the length of the lift arms 22, 24 to move the grippers 40 and refuse container 42 toward the hopper 16. The outer support rails extend a controlled distance to position the grippers 40 on opposing sides of the container 43, with the gripper leveling piston 46 adjusting the position of the grippers 40 relative to the ground and to the container 42 to enable gripping the container 42. The grippers 40 and gripper pistons provide a refuse container gripping mechanism. The grippers 40 are raised and lowered relative to the carriage assembly 50 by the leveling cylinders 46, all of which reciprocate with the upper carriage 50. During extension and retraction of the lift arm 22, the leveling cylinders 46 are automatically actuated to maintain the grippers 40 at a substantially level attitude. This level attitude of the grippers 40 is preferably maintained as the upper carriage 50 travels up and down the straight, first portion 22 of the lift arm 20. This orientation ensures that the refuse container 42 will be maintained in a vertical orientation as it traverses the length of the lower arm portion 22 so that the container contents do not spill onto the sidewalk or road.

Referring to FIGS. 1-12, the first portion 22 of lift arm 20 comprises spaced apart, parallel, upper tracks 54 which may be connected by divider 56 which is preferably a sheet metal plate. The tracks 54 and divider 56 extend most or all of the length of the first arm portion 22. The divider 56 and upper tracks 54 preferably defines an outwardly facing (or upwardly facing when extended) open channel for receiving and guiding upper carriage 50 and a flexible, elongated drive member 58, such as a drive chain or belt which may be repeatedly flexed in opposite directions without undergoing fatigue damage. The divider 56 has a cross-sectional shape that resembles a hat shape preferably formed by two opposing flat sides inclined toward each other at an angle of about 45 degrees and joining a flat top, with the tracks 54 extending along the inclined sides opposite the flat top. The carriage 50 straddles that raised portion of the divider 56 and moves along it. The extending middle portion of this divider creates an enlarged space on the bottom side of the divider within which other parts may fit as described later.

Figure 8:
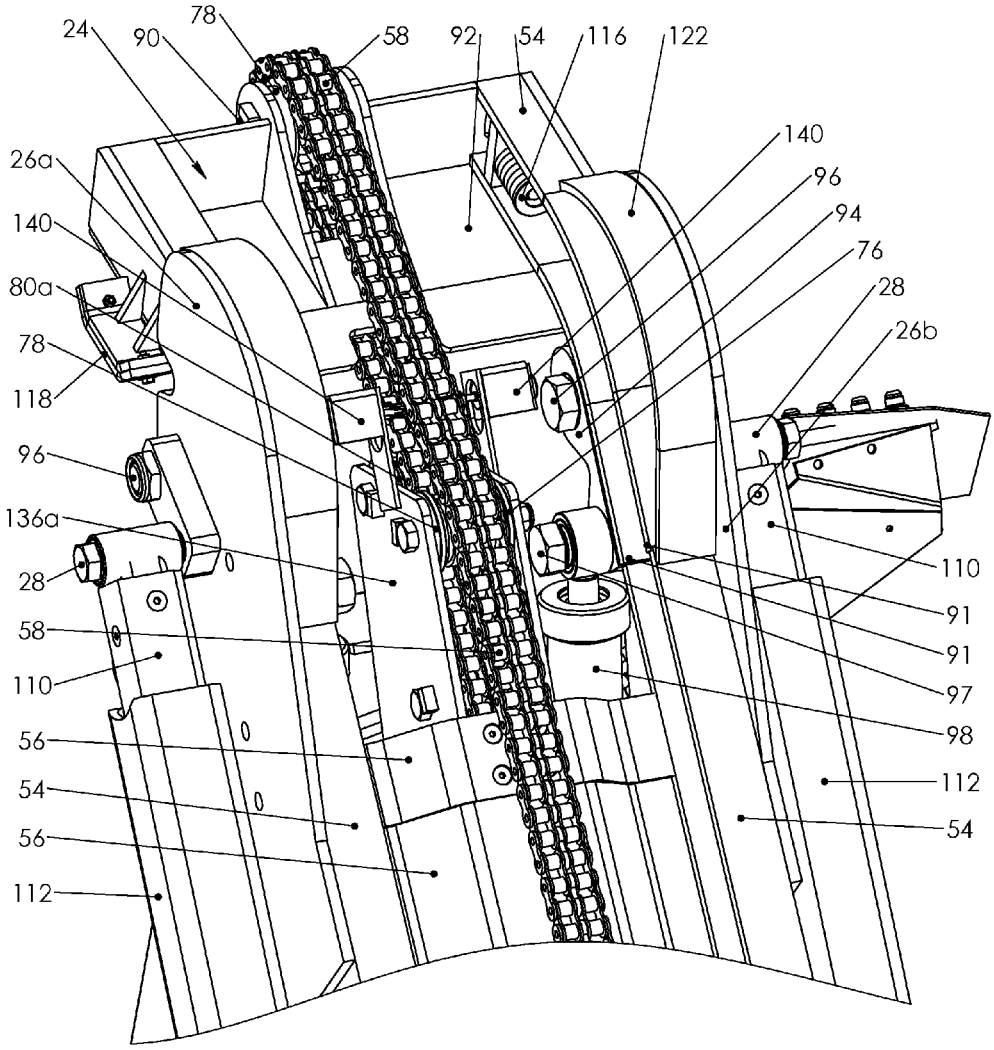
FIG. 8 as a partial perspective view of a side loader with the carriage approaching the beginning of the upper, curved portion of the side loader.
Figure 9:
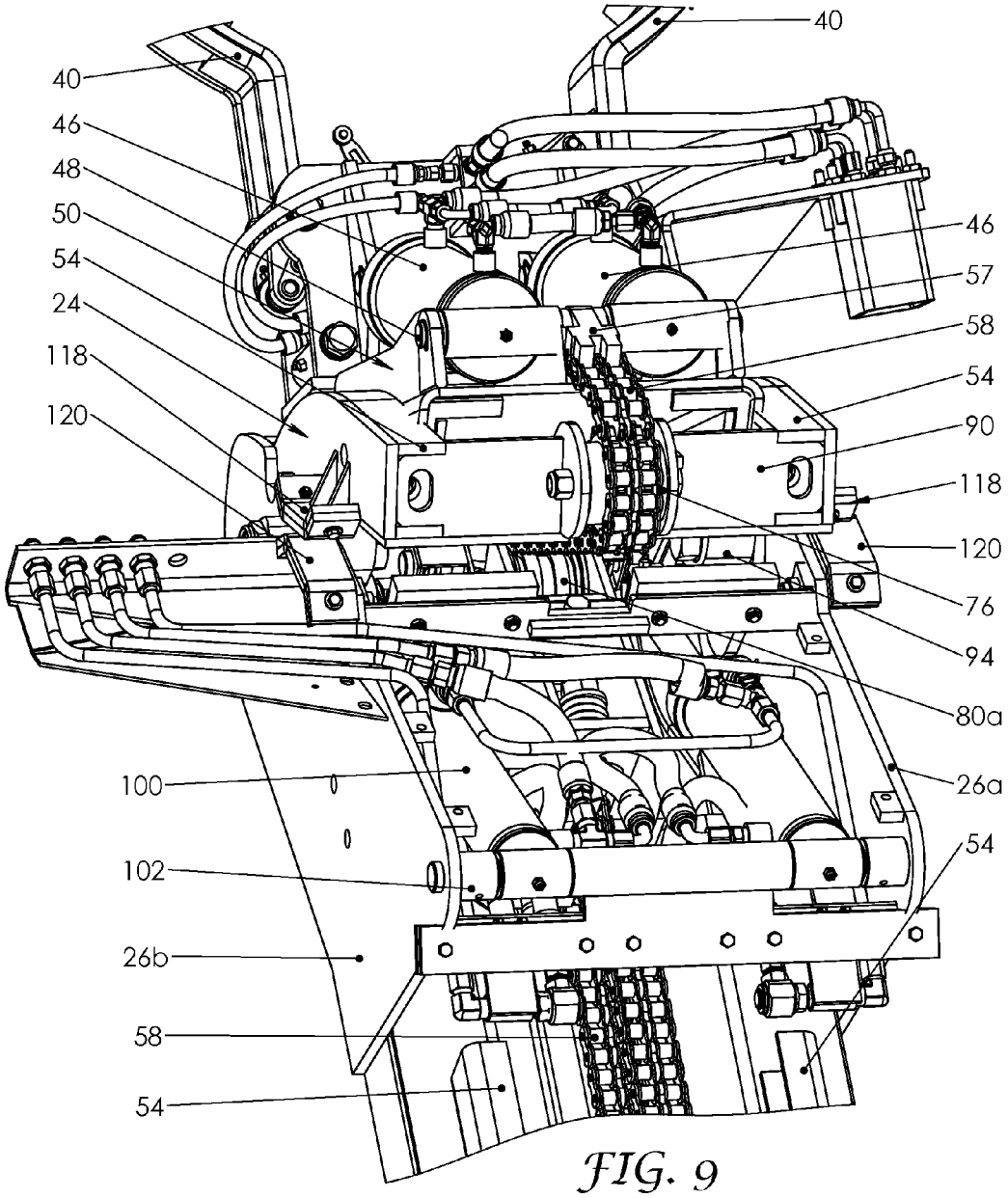
FIG. 9 is a partial perspective view of a portion of the carriage at the end of the curved, upper portion of the side loader with the carriage and curved portion of the side loader ready to be rotated into a second, dump position, looking from the vehicle outward.
Figure 10A:
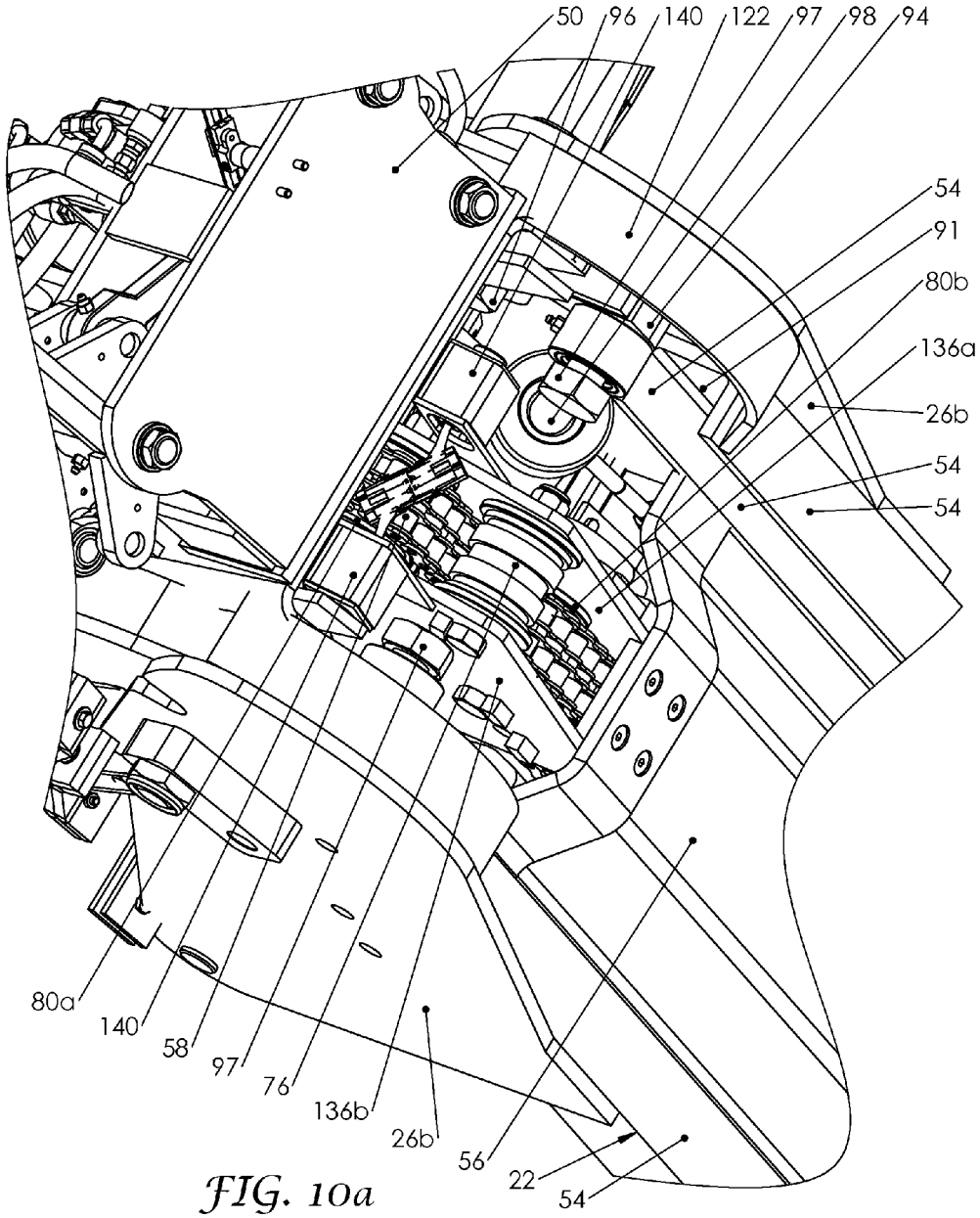
FIG. 10*a* is a partial perspective view of a portion of the carriage and curved portion of the side loader in a second position.
Figure 10B:
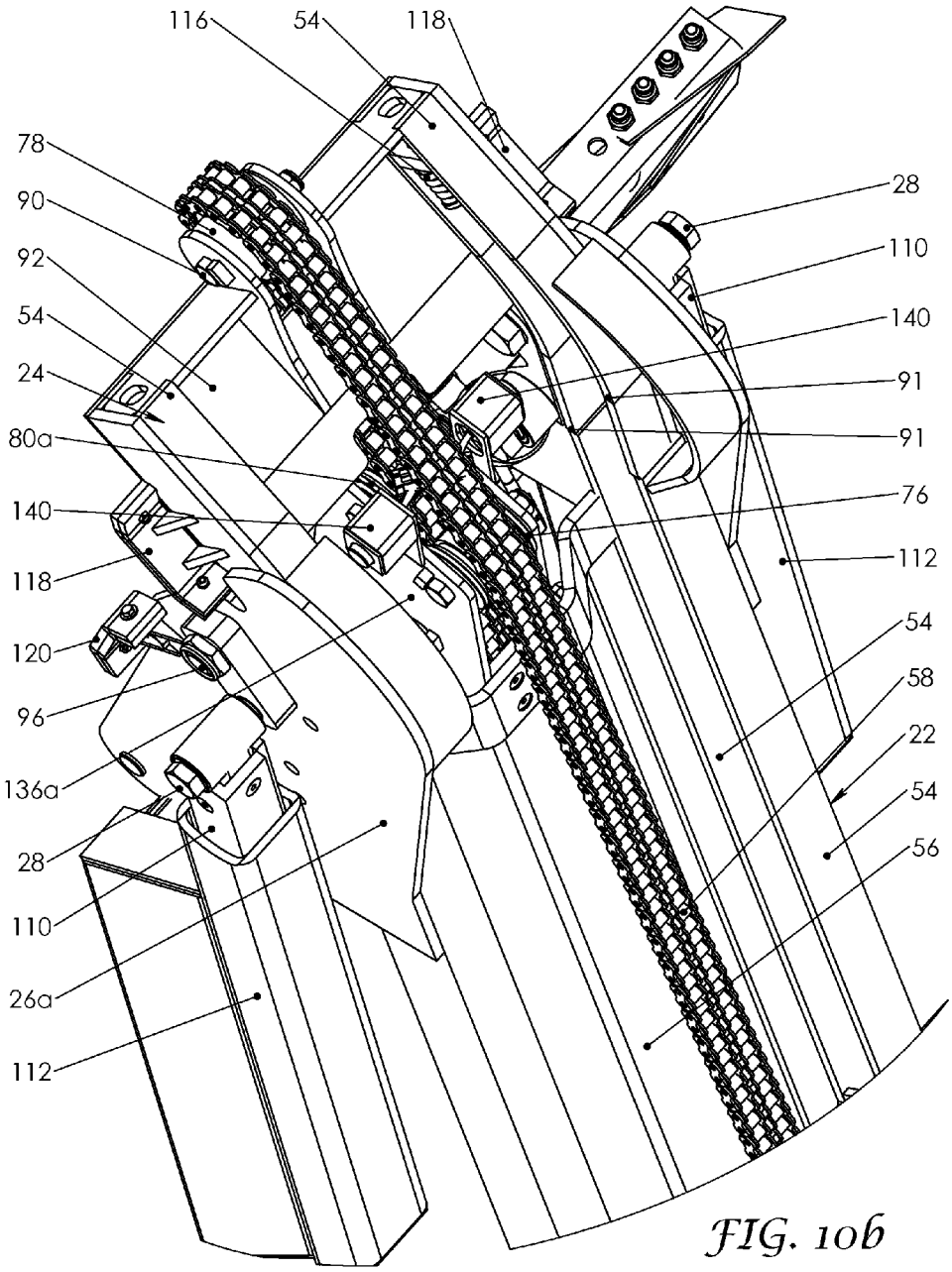
FIG. 10*b* is partial perspective view of a portion of the carriage and curved portion of the side loader in a first position.
Figure 11:
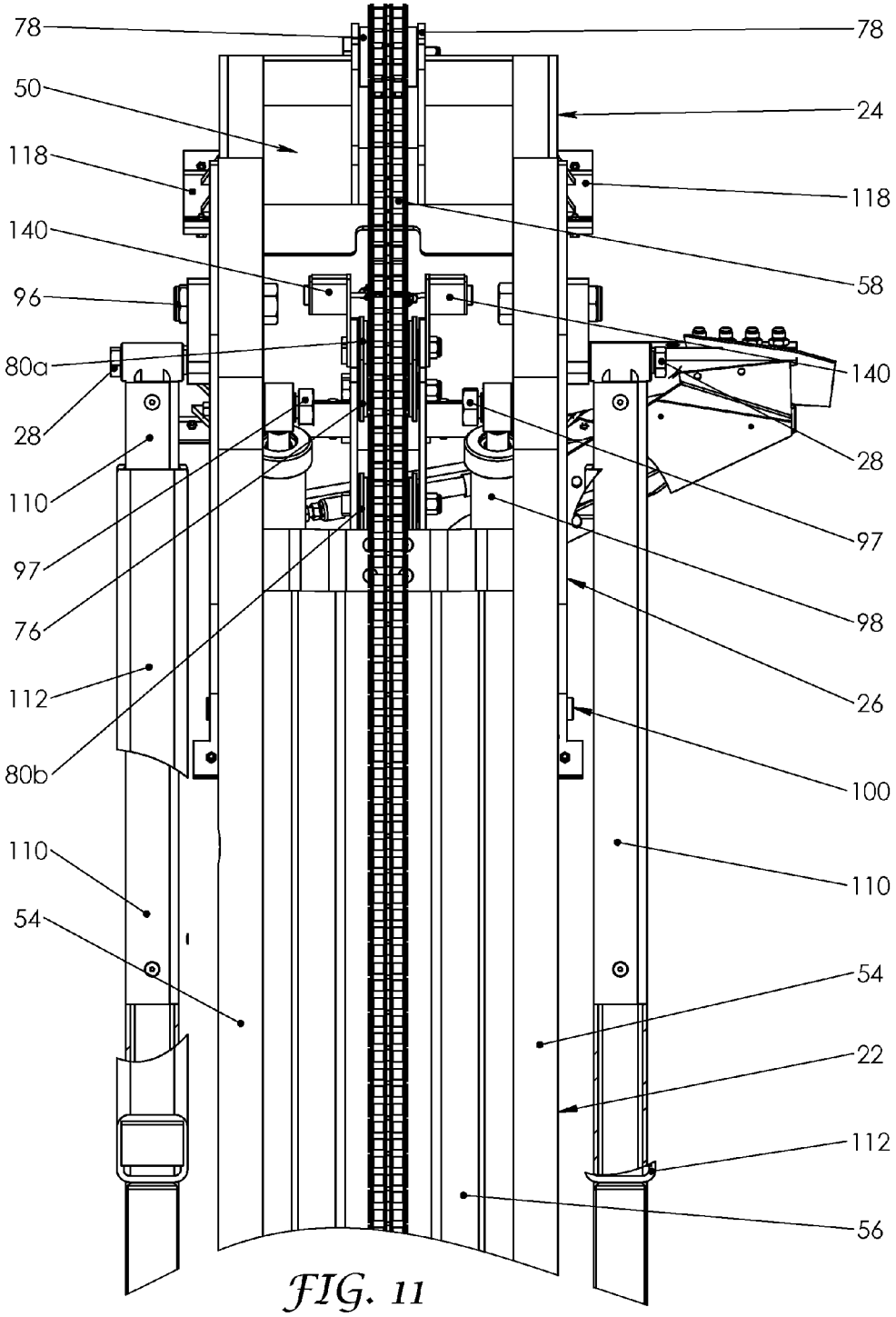
FIG. 11 is a partial plan view showing a portion of the carriage and the curved portion of the side loader.

The upper tracks 54 each have a generally C-shaped cross-section which opens toward the other upper track 54, as best seen in FIGS. 7-8 and 10. Returning to FIGS. 1-12 the upper tracks 54 form guide channels within which wheels 60 (FIG. 13) are mounted to upper carriage 50 so the wheels roll along and within the upper tracks 54 so the carriage can move along upper track 54. The wheels 60 are preferably on axels (not shown) mounted to upper carriage 50 and are confined between opposing ends of C-channel upper track 54 to confine the movement of carriage 50. There are preferably four wheels 60 on the upper carriage 50, two on each side. The flat top of the divider 56 is preferably located between the opposing ends of the C-shaped cross-section against which the wheels 60 abut to position the upper carriage 50. The upper carriage 50 is generally rectangular having sides parallel to the sides of upper tracks 54. A plurality of the wheels 60 with rotational axes parallel to longitudinal axis 21 are connected to the upper carriage 50 so the round surface of the wheel abuts the ends 62 of the C-shaped channel forming upper tracks 54. A plurality of wheels are also preferably, but optionally connected to the carriage with their rotational axes orientated orthogonal to the longitudinal axis 21 so the rolling surface of the orthogonal orientated wheels abut the side of the channel or upper track 54 to restrain movement of the carriage parallel to the longitudinal axis. The wheels 60 on carriage allow the carriage to move freely along the upper track 54 which extend the length of the first arm portion 22 and the length of second arm portion 24. Because the divider 56 extends outward between the opposing upper tracks 54, the body of the carriage straddles this outward extending section so that most of the body of the carriage 50 is located above the rotational axis of the upper carriage wheels 60. This has the effect of offsetting the connection with the grippers 40 further away from the rotational axes of the wheels 60 than in the prior art.

The upper carriage 50 and upper track 54 are on an outward side of the divider 56 facing away from the vehicle 12. On the opposing, inner side of the divider 56 and preferably in the space formed by the inclined sides of the bottom are first and second chain drive pistons 62*a*, 62*b*. The pistons 62*a*, 62*b* are mounted parallel to each other and extend in opposing directions, with each piston aligned to extend and retract along the length of and parallel to the first arm portion 22. A pair of spaced apart and parallel lower tracks 64 extends the length of the first arm portion 22, but on the opposing side of the divider 56 as the upper tracks 54. The lower tracks 64 are preferably not spaced as far apart as the upper tracks 54 and may be located between the upper tracks 54 but on the opposing side of divider 56. Advantageously the lower tracks 64 have a partially closed end at each end of the tracks 64 to form a motion limit stop to prevent a lower carriage (described later) from passing beyond the end of the tracks 64 and disconnecting from the lower tracks.

Figure 12:
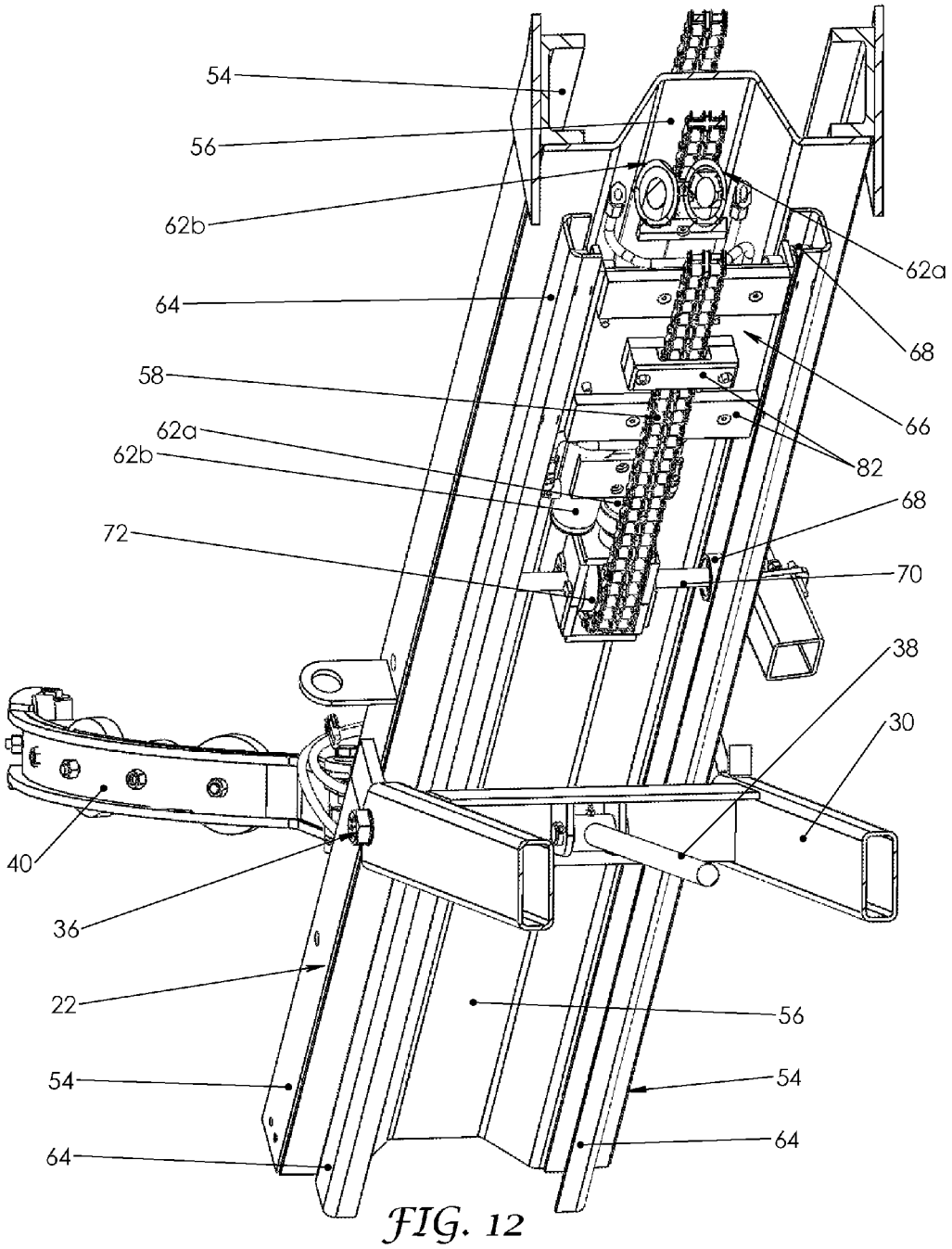
FIG. 12 is a partial perspective view showing a bottom view of a lower portion of the side loader of FIG. 2.
Figure 13:
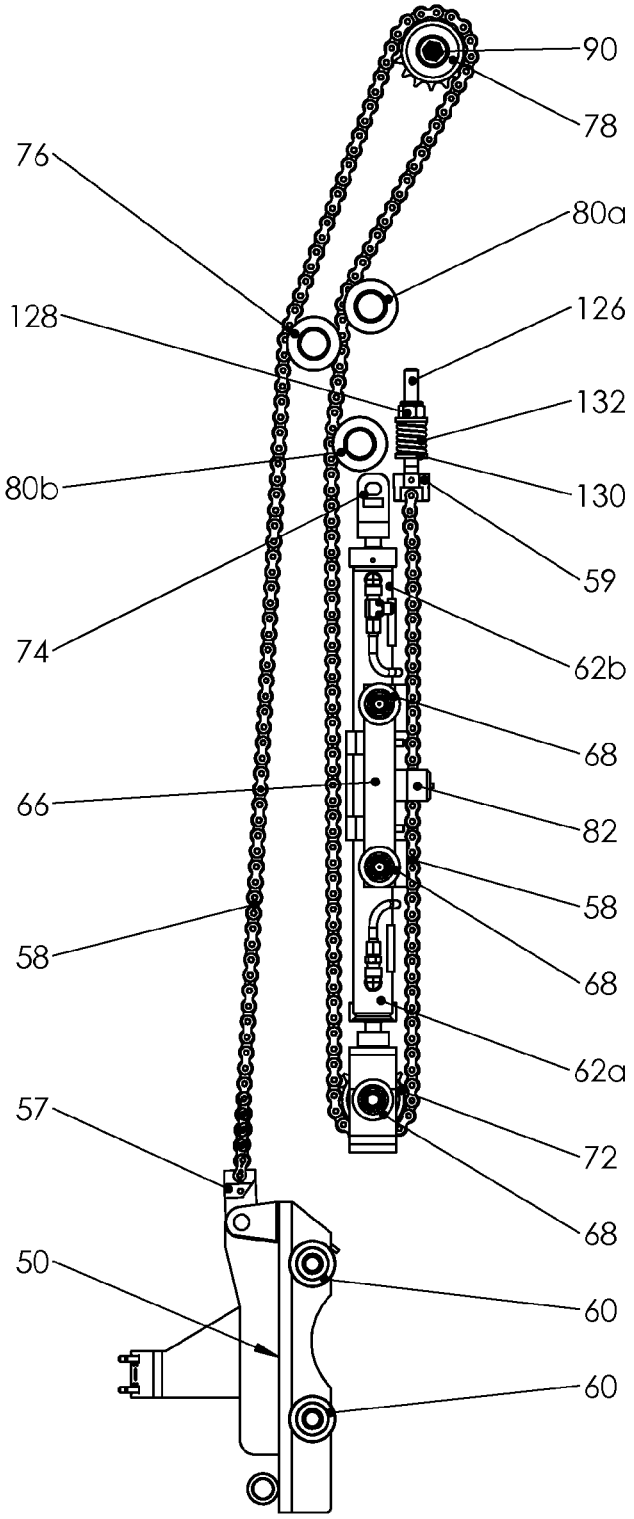
FIG. 13 is a schematic view of a chain drive using two opposing hydraulic cylinders.

Referring further to FIGS. 12-13, the lower tracks 64 each have a C-shaped cross section which opens toward the other lower track 64. A lower carriage 66 having wheels 68 (FIG. 12) is mounted to move along the lower track 64. A plurality of the wheels 68 with rotational axes parallel to longitudinal axis 21 are connected to the lower carriage 66 so the round, rolling surface of the wheel abuts the ends of the C-shaped channel forming lower tracks 64. A plurality of wheels 68 are preferably, but optionally also connected to the carriage 66 with their rotational axes orientated orthogonal to the longitudinal axis 21 so the, round rolling surface of the orthogonal orientated wheels abut the side of the channel or lower track 64 to restrain movement of the lower carriage parallel to the longitudinal axis. The wheels 68 on carriage allow the lower carriage to move freely along the lower track 64 which extend most or all of the length of the first arm portion 22.

Referring to FIGS. 7-13 and especially FIGS. 12-13, first chain drive piston 62*a* has a distal end pivotally connected to a lower movable support 70 that can move along the length of the lower arm 22. The first chain drive piston 62*a* is shown as connected to a shaft, extending between a pair of wheels 68 each of which is sized to fit within and rotate along one of the opposing, lower tracks 64, between the opposing flanges forming the C-channel of the lower track 64. A lower rotating part 72, preferably a lower return roller 72 or sprocket is connected to the lower movable support 70 and may preferably freely rotate about that shaft 70. As the piston 62*a* extends and retracts the movable shaft 70 and lower return roller 72 move toward and away from the bottom end of the first arm portion 22 and also move toward and away from the lower carriage 66—depending on the extension of the first piston 62*a*.

The second chain drive piston 62*b* has its distal end pivotally connected to a ground point, preferable to one or both of the side supports 26*a*, 26*b* and more preferably to a shaft extending between the side supports 26*a*, 26*b*. Preferably an upper fixed support 74 such as a cross-bar or shaft extends between the opposing side supports 26*a*, 26*b* and the distal end of piston 62*b* connects to that upper support 74. Alternatively, a cantilevered post can extend from one of the side supports 26 to connect to the distal end of the piston 62*b*. The connection preferably allows rotation of the distal end of piston 62*b*. As second piston 62*b* extends and retracts the lower carriage 66 is pushed away from or moved toward the upper fixed support 74 and support plates 26.

Referring to FIGS. 8-11 and 13, connected to at least one of the side supports 26*a*, 26*b* are also various rotating parts, preferably upper guide roller 76 (FIG. 10) and a pair of upper support roller 80*a*, 80*b* on the inside of the chain 58 with roller 80*a* above roller 80*b* and roller 80*a* located relative to guide roller 76 so the chain 58 is between them. An upper return roller 78 (FIG. 8) is connected to the second arm 24 and allows the chain 58 to reverse direction. The upper guide roller 76 helps maintain the chain 58 in position to move the upper carriage 50, helps guide the chain onto the second arm 24, and helps maintain the chain on the roller 80*a* when the second arm rotates to a dump position as discussed later. Each of the rollers 76, 78, 80 are preferably mounted so they freely rotate about shafts, with rollers 76, 80*a*, 80*b* mounted to shafts extending between side supports 26*a*, 26*b*, or cantilevered from one of them, or otherwise supported in position. The use of these rollers with the drive chain 58 to move the upper carriage 50 will be described later.

Referring to FIG. 12, there is shown a guide block 82 that helps maintain the position of the chain 58 passing below the divider 56. The chain 58 may be a heavy lift chain, with a 15,000 pound rating being believed suitable, but the size may vary with the intended use. Because the chain 58 is heavy it will sag downward differing amounts depending on the tension in the chain and the distance between supports for the chain. Guide blocks 82 are made of a suitable, durable elastomer and allow the chain 58 to either pass over them and avoid rubbing against the metal parts of the divider 56 and sliding sideways off the various sprockets, or the guide block may have an opening through which the chain 58 passes as shown in FIG. 12, to maintain the position of the chain relative to the first arm portion 22. The depicted guide block 82 has two rectangular blocks with a slot formed on one face of the block to accommodate the chain 58, with the slots of two blocks being aligned to restrict movement of the chain except through the slot, thus, clamping the chain to the lower guide block 66 but along it to pass through the block. Such guiding and supporting surfaces may be provided as needed to keep the chain 58 on track.

Referring to FIGS. 3-6, 8 and 10, the second arm portion 24 is separable from and movable relative to the first arm portion 22. The second arm portion 24 has the same cross-sectional shape as the first arm portion except it lacks the lower track 64 and shaped divider 56. The second arm portion 24 thus has C-shaped upper tracks 54 located to provide a rolling surface along which carriage wheels 60 may smoothly travel. The upper arm portion 24 is shown with two short but straight end segments about 7 inches long, connected by a curved middle portion that subtends an arc of 20 degrees and a length of about 9 inches so the lower segment is aligned with the first arm portion and the upper, distal segment is angled about 20 degrees from the longitudinal axis of the first arm portion 22, toward the hopper 16. The sprocket or guide wheel 78 is advantageously mounted at the distal ends of the tracks 54 on the second arm member 24 as seen in FIG. 8. Some of the curved portion of the arm 24, and some of the distal straight portion of the second arm portion 24 preferably extend beyond the side supports 26*a*, 26*b*. To further strengthen the second arm portion 24, a bottom support 92 (FIG. 8) may join the lower sides of the cross member 90 and the distal end of second arm 24.

The second arm portion 24 is pivotally mounted to each side support 26*a*, 26*b* by a short trunion or pivot assembly 28 the rotational axes of which is parallel to the longitudinal axis 21 and located slightly below the upper track 54 and adjacent the lower end of that track 54 on the upper arm portion 24. The pivot assemblies 28 are on a common pivot axis that as noted, is preferably parallel to the longitudinal axes 21 as the arms 22, 24 extend in a plane perpendicular to that axis 21. The second, upper arm portion 24 rotates in part about this common pivot axis to dump the container 42 as described in detail later.

The second arm portion 24 rotates between two positions. In the first position the upper tracks 54 of the first and second arm portions 22, 24 align and preferably abut along joint line 91 (FIGS. 7, 8) so that the wheels 60 and upper carriage 50 can pass between the first and second arm portions 22, 24. In the second position the upper tracks 54 of the arm portions 22, 24 are separated as the second, upper arm portion 24 rotates to dump the refuse container 42 when the carriage 50 is located in the second, upper arm portion. The rotation is achieved by a linkage mechanism described below.

Figure 5A:
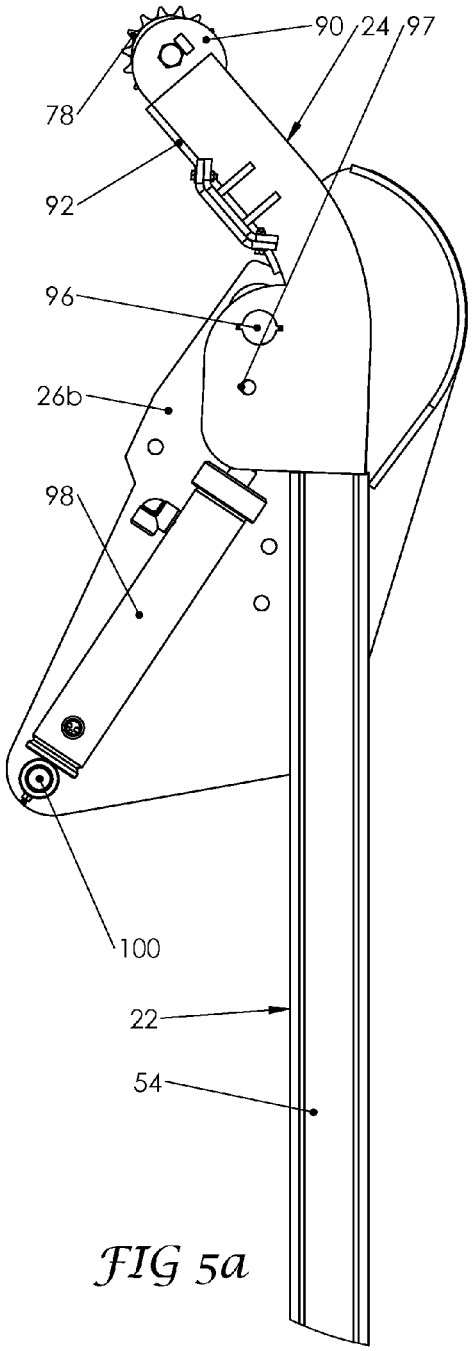
FIG. 5*a* is a partial side view of a portion of a side loader with an upper arm in a first position.
Figure 5B:
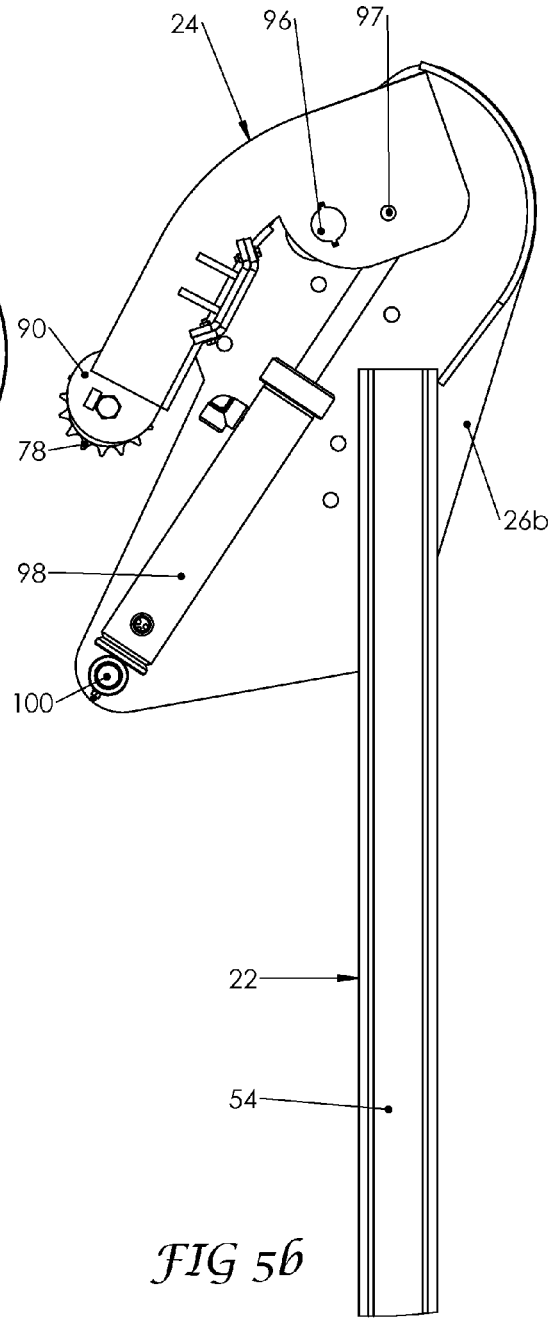
FIG. 5*b* is a partial side view of a portion of the side loader with the upper arm in a second, emptying position.
Figure 6:
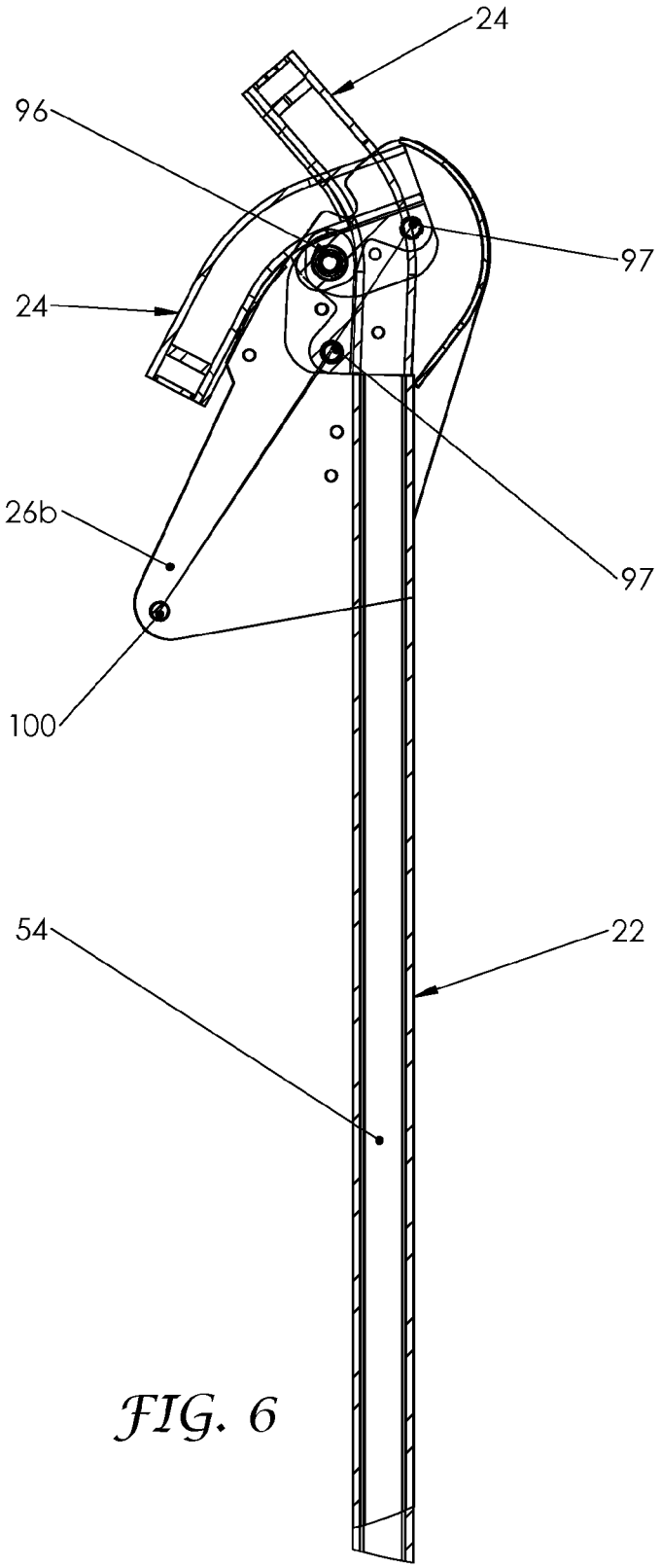
FIG. 6 is a partial side view with the parts of FIGS. 5*a* and 5*b* overlaid.

Referring to FIGS. 5*a*, 5*b* and 6, a three bar linkage mechanism on each side support 26*a*, 26*b* may be used to rotate the second arm portion 24 and the carriage 50 held in the upper track 54 of that second arm portion 24. As the linkages are the same only one is described. The linkage mechanism includes the second arm portion 24 as the driven link that is connected to and rotates about pivot 96 that is in turn connected to one of the side supports 26, which represents part of the ground link. The side support 26 advantageously does not rotate or move vertically during dumping so the pivot 96 remains stationary during dumping. The pivot 96 connects to the upper arm 24 adjacent the center of the curved part of upper arm 24, and below the upper track 54. The pivot point 96 is preferably located on a first end of a rotating link 94 that is welded or otherwise connected to the lower, straight leg of the upper arm portion 24. A second pivot 97 is located on an opposing, second end of rotating link 94. The pivots 96, 97 may comprise rotating pivot pin assemblies. The second pivot 97 is located adjacent the lower end of the upper arm portion 24, adjacent the juncture 91 between the upper ends of the lower arm portion 22. The pivot 97 connects to the extendable end of hydraulic dump piston 98, which has its base rotatably connected to a shaft 102 (FIGS. 9-10) extending from or between the lower portions of side supports 26*a*, 26*b*, to form a pivot axis 100. The longitudinal axis of the dump piston 98 is offset from and preferably offset below the pivot axis 96 when the upper arm portion 24 is in the first position, with the pivot connection 97 to the rotating linkage 94 and arm portion 24 being below pivot axis 96 when the upper arm 24 is in the first position, and above pivot axis 96 when the upper arm portion 24 is in the second, dump position.

As best seen in FIGS. 5*a*, 5*b* and 6, when the hydraulic dump piston 98 is in the retracted position the upper and lower arm portions 24, 22 align and preferably abut along joint 91 (FIG. 8) to form a continuous path along which the carriage 50 travels with the wheels 60 guided by upper tracks 54. As the dump piston 98 extends it rotates the upper arm portion 24 about pivot 96, with the piston 98 rotating about pivot 100 into the second, dump position. The extension of the dump piston 98 is sufficient to invert the refuse container 42. Retraction of the dump piston 98 returns the upper arm portion 22 to its position adjacent the upper end of lower track portions 22 and juncture 91, with the tracks 54 aligned so the carriage 50 and associated gripper 40 and refuse container 42 may return along the lower arm portion 22. The three bar linkage is thus formed by the extendable dump piston 100, the rotating link 94 (part of upper arm portion 24) and the side flange 26 which is the ground connecting the pivot axes 96 and 100.

As the dump piston 98 extends it pushes upward on the lower end of the second arm portion 24 and causes the upper arm portion 24 to rotate about pivot 96. The rotating linkage 94 offsets the pivot axes 96, 97 on what is the lower end of the upper arm 24 when the arm 24 is in the first position. In that first position, the carriage 50 and refuse container 42 are on the opposing end of the upper arm portion so the dump piston 98 prevents rotating of the upper arm 24 about the pivot 96. As the dump piston 98 extends the weight of the upper carriage 50 and refuse container 42 help rotate the refuse container 42 and upper arm 24 to the second, dump position and when the upper arm rotates the weight helps rotation and helps to empty the contents of the refuse container 42. The dump piston 98 thus rotates the second arm portion 24 about the pivot 96 in the path defined by the movable end (pivot 97) of linkage 94 which rotates about pivot 96. The dump piston 98 thus moves the second, upper arm portion 24 into the second, dump position as it extends. As the piston 98 retracts it moves the second, upper arm portion 24 into the first position where the first and second arms 22, 24 preferably abut along joint 91, with the track 54 on each arm being aligned so the carriage 50 may move along the tracks 54 to set the now empty container 42 on the ground.

As the second arm portion 24 rotates between the first and second positions the refuse container 54 rotates along with carriage 50. The second position of the second arm portion 24 places the refuse container 42 in an inverted position to dump the contents into hopper 16. Any lid 41 on the refuse container 42 falls open with gravity or forced by the weight of the contents moving downward with gravity. Because the pivot locations which rotate the second arm portion 24 are the same lateral distance from the longitudinal axis 21 of the vehicle 12, the contents of the container are dumped in the same location in the hopper 16 for a highly repeatable emptying sequence. Advantageously, the leveling cylinder 46 of gripper 40 holds the container 42 at a dump angle of about 50° or more relative to a vertical axis during dumping. Preferably the configuration of the second, rotating arm portion 28 is such that the upper carriage 50 places the container 42 in the desired dump angle as the arm portion 28 rotates from the first position to the second, dump position—without having to alter the leveling cylinders 46 from the angle maintained as the container travels the length of the lower arm portion 22. This dump angle and the location of the refuse container 42 in the hopper 16 are highly repeatable so the contents of the refuse container are consistently emptied at the same location in the hopper. The preferred location for emptying is centered on or at least intersecting the longitudinal axis of the vehicle 12.

Referring to FIGS. 2 and 13, the drive chain 58 has a first end 57 fastened to upper carriage 50 located on the outer side of divider 56. A clevis and pin connection is preferred for connecting first end 57 to the carriage 50. The connection, best seen in FIGS. 7 and 9, allows the connection with the chain 58 to rotate relative to the upper carriage 50, while the carriage 50 is constrained to move along the two opposing and parallel tracks 54 in the two arms 22, 24. When the carriage 50 is in the lower position shown in FIG. 2 to pick up a trash container 42, the chain 58 runs along the outer surface of the divider 56 and across the top of the upper guide roller 76, which is positioned so the chain 58 extends in a generally straight line along the divider 56. After passing over the upper guide roller 76 the chain 58 extends around a majority of the upper return roller 78 so as to change directions and return back along its original path, but offset below that original path. After passing around the upper return roller 78 the chain 58 passes over the top of the upper support rollers 80*a*, 80*b* and then extends along and generally parallel to the divider 56 but on the lower side of that divider until the chain passes the lower carriage 66 and passes around the lower return roller 72. The lower return roller 78 changes the direction of the chain again so it passes back toward and past the lower carriage 66 to connect to one of the side supports 26 or a shaft extending from or between the side supports. As seen in FIG. 12, preferably the chain 58 passes over the lower side of the lower carriage 66 and over the lower return roller 72 and returns along a path that is closer to the divider 56 to connect to the side support 26.

The second end 59 (FIG. 13) of the chain 58 is connected to the vehicle 12 directly or indirectly, and preferably indirectly by being connected to one of the upper end of the first arm 22, or preferably by being connected to one of the side plates or side supports 26*a*, 26*b* which are in turn connected to the vertically extendable members 110 in vertical members 112 connected to the vehicle 12. Advantageously the second end 59 of the chain 58 has a resilient, tension device such as a spring 132 as well as a length adjustment device such as a threaded shaft 126 cooperating to adjust the length of the chain and to tighten or loosen the chain 58 while maintaining tension resiliently, and with the spring also absorbing sudden changes in the force in the chain to help reduce sudden jerks as the chain moves. More preferably, the second end 59 of the chain 58 fastens to a support shaft extending between side plates 26*a*, 26*b* with the resilient, tension adjustment mechanism interposed between the end 59 and the location on the vehicle. The second end of the chain 58 thus preferably fastens at a fixed location to the vehicle, but preferably in a manner that allows the second end 59 to pivot about its axis as the angle of the chain 58 may change.

Figure 14:
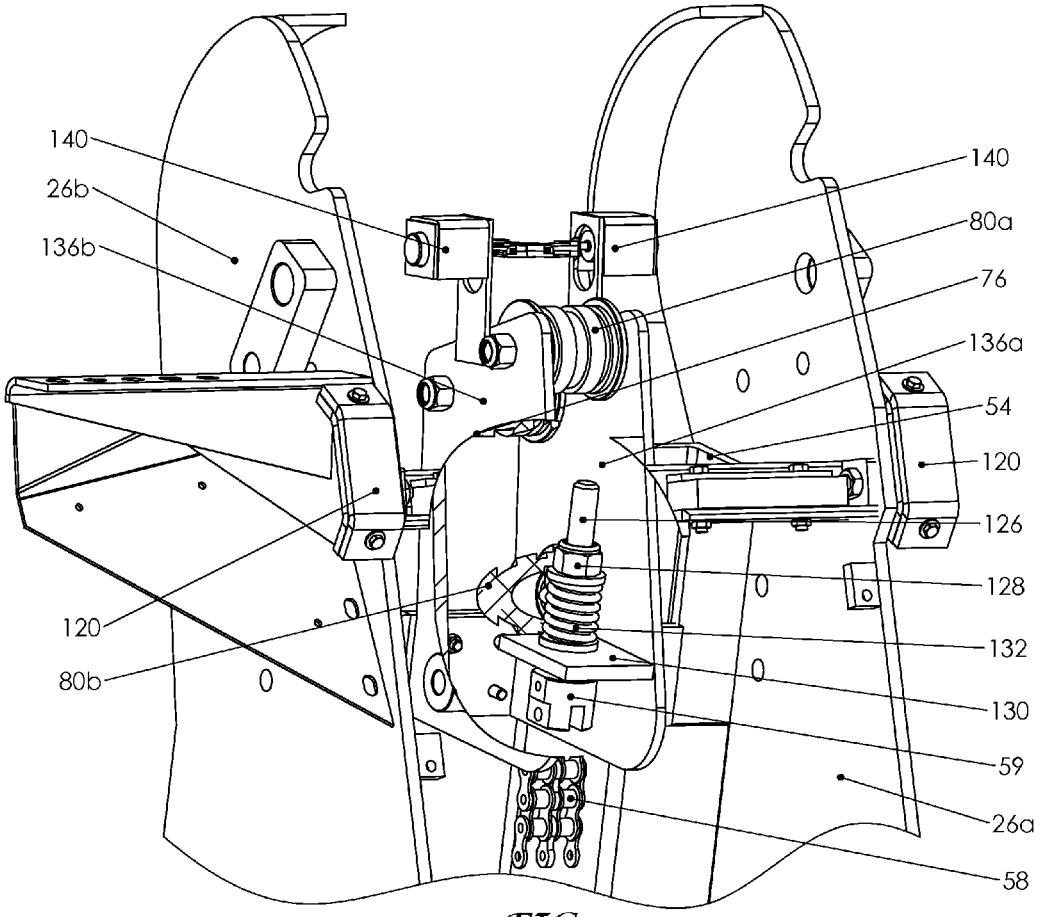
FIG. 14 is a partial perspective view of the upper end of the first arm section looking from the vehicle outward, with the second arm portion removed.

Referring to FIGS. 13-14, a U-shaped yoke or a pin and clevis joint is believed suitable for connecting the second end 59 of chain 58 to the resilient, tension adjustment device which in turn has a coil compression spring 132 with a central threaded shaft 126 passing through the center of the spring for length adjustment of the shaft 126 and chain 58. A spring keeper plate is fastened between a pair of interior support plates 136*a*, 136 that are in turn mounted in fixed position relative to and preferably parallel to side supports or side plates 26*a*, 26*b*. The spring keeper plate 130 extends across the axis along which chain 58 extends. The keeper plate 130 has a hole through which the threaded shaft 126 extends with the second end connector 59 and chain 58 on the lower side of the plate 130 and the major length of shaft 126 on the other side of the plate 130. The threaded shaft 126 passes through the spring and nut 128 with the nut being advanced on the shaft 126 toward the keeper plate 130 to shorten the length of the shaft and chain 58 and to compress spring 132. The nut 128 is moved away from keeper plate 130 to lengthen the chain 58. Loosening or tightening the fastener 128 adjusts the compression of the spring 128 and adjusts the length of the flexible, elongated member 58. The exact details of the connection are not as important as it is that the second end 59 be at a fixed location connected to the vehicle 12 and that the first end 57 be connected to the upper carriage 50, with the chain passing over rotating parts 72, 78 to change direction twice, so that movement of the rotating part 78 causes the effective length of the chain to change and thus move the upper carriage 50.

In operation, because the length of the chain 58 is a fixed, predetermined length, then as the lower return roller 72 moves a distance X along the length of the first arm portion 22, the effective length of the chain 58 changes by a distance of 2X. Chain drive pistons 62*a*, 62*b* control the position of the lower return roller 72. As the pistons 62 extend the distance between the upper support 74 and the lower return roller 72 increased a distance X, the effective length of the chain connected to upper carriage 50 is shortened by 2X and that causes that upper carriage to move by a distance 2X so that the upper carriage 50 and container 42 move toward the hopper 16 where the container can be emptied. Likewise, by shortening the distance between the lower return roller 72 and the upper support 74 by a distance X, the effective length of the chain is lengthened by 2X, causing the upper carriage to move by 2X in the opposite direction, namely to move away from hopper 16 and toward the bottom end of the first arm portion 22 to pick up or set down container 42. Because both chain drive pistons 62*a*, 62*b* are connected to the lower carriage 66, the lower carriage moves a distance X in order to cause the upper carriage 50 to move a distance 2X. By mounting both pistons 62*a*, 62*b* on a movable carriage 66 the effective change in the length of the chain 58 can be doubled, and the use of two shorter, sturdier pistons 62 provides for a more compact construction, more reliable construction, and more accurate positioning as compared to using a single piston with the same extension and retraction length. The extendable drive pistons 62*a*, 62*b* connected to the lower carriage 66 and cooperating with the elongated drive member or chain 58 comprise a drive means. The drive means includes rotating part 78 which reverses the direction of the flexible drive member 58, and the movable and rotating part 72 which reverses the direction of the flexible drive member 58 and allows the rotating part 72 to move to change the effective length of the drive member.

Referring to FIGS. 8-10 and 13, as the carriage 50 approaches the upper arm 24 as shown in FIG. 8, the chain 58 passes over the upper guide roller 76 and then over and around the upper return roller 78 located on a cross member 90 extending between the distal ends of the upper arms 24, after which the chain passes along the support sheet 92, over upper support roller 80*a* (adjacent roller 78) and 80*b* and then returns inside cover 56 and the lower track 64. When the second arm 24 rotates from the first to the second position, the chain 58 wraps around the upper support roller 80*a*, with no chain wrapped around upper guide roller 76. The divider 58 does not extend onto the second arm portion 24 and that second arm portion 24 is generally open in its central area so the chain 58 does not hit any divider as the second arm portion 24 rotates between positions. The location of the rollers 76, 78 is preferably at about the location of the center of the curved portion of the second arm portion 24. For stability, the distal end of the second arm portion 24 is joined by cross member 90 and the lower portion may have a further stiffening sheet support 92 that preferably does not extend far enough toward the curved portion to hinder movement of the chain 58.

Referring to FIG. 9, as seen from the opposing side and with the carriage 50 located at the end of the second, upper arm portion 24, the chain 58 passes over upper return roller 78 connected to cross member 90 and returns over the upper roller 80*a* and between rollers 80*a* and 76 (not shown in FIG. 9). In FIG. 9, the second arm 24 is in the first position just ready for rotation to the second position for dumping the contents of any container held by the grippers and moved with the upper carriage 56.

Referring to FIG. 10, after the second upper arm 24 is rotated to the second, dump position by the extended piston arms 98, the carriage 50 is rotated about pivot 96. The chain 53 wraps around upper roller 80*a* with the upper carriage 50 shown to the left in FIG. 10. Thus, as the second, upper arm portion 24 rotates about pivot axis 96 (FIGS. 5*a*-5*b*) the chain 58 wraps around the upper support roller 80*a*, leaving upper guide roller 76 exposed and uncontacted by chain 58.

After unloading the receptacle 42, the second arm portion 24 is rotated back to its first position, whereupon the chain 58 is moved in the opposite direction to reverse the sequence and move the upper carriage 50 to the lower end of the first arm portion 22 to release the trash receptacle 42. The upper carriage 50 is on wheels 60 guided by and contained within upper tracks 54 that preferably take the form of C-shaped channels. The spaced apart upper tracks 54 confine the upper carriage 50 and keep it from moving relative to the tracks 54 as the second arm portion 24 is rotated between the first and second positions. The pivots 96 and 97 are suitably constructed to provide a sturdy and stable support as the second arm portion 24, upper carriage 50, gripper 40 and refuse container 42 are rotated between the first and second positions. Moreover, as best seen in FIGS. 2 and 5*a*, during operation the distal end of the second arm portion 24 is slightly inclined in an upward direction during use.

One or more sensors 140 (FIG. 14), preferably proximity sensors, may detect the upper carriage 50 or the chain 58 to determine when the upper carriage 50 is at the upper or distal end of the second arm portion 26 either ready for the refuse container to be dumped, or to determine when the upper carriage has been returned from the second, dump position. The sensor(s) 140 confirm the position of the upper carriage, gripper and refuse container before dumping them, and confirm the position after dumping, so the carriage is not caught part way onto or off of the second arm portion 26 during rotation. Various types of known sensors may be positioned to verify the location of the carriages and operation of the various parts, especially the grippers 40. The sensors may be used to control the speed with which the carriages move. As these controls are known, they are not described in detail.

Also shown in FIG. 14 is an optional resilient stop 142 located inward of the upper rail 54 adjacent the upper end of the rail 54 on the first arm portion 22. Stop 142 may be used to abut a portion of the lower carriage 66 or items mounted on the carriage in order to resiliently limit the motion of the carriage.

When the second arm portion 24 is in the first position, the weight of the carriage 50, gripper 40 and refuse container 42 provide a downward force which helps keep the chain 58 tight. Thus, as the length of the chain 58 is effectively lengthened by retracting hydraulic pistons 62*a*, 62*b*, the weight on the carriage 50 helps move the upper carriage 50 toward the ground where the refuse container 42 may be released. When the upper carriage 50 is in the pick-up position adjacent the ground so the grippers 40 may grab a refuse container 42, the hydraulic chain drive pistons 62*a*, 62*b* are retracted in order to increase the available length of chain 58 needed to move carriage 58 to the end of the first arm portion 22. When the chain drive pistons 62*a*, 62*b* are retracted the lower carriage 66 approaches the upper end of the lower arm portion 22. As the chain drive pistons 62*a*, 62*b* are extended they take up some of the length of the chain and effectively shorten it, causing the upper carriage to move toward the upper, second arm portion 22. As the chain drive pistons 62*a*, 62*b* extend, the lower drive carriage 66 moves toward the bottom of the lower arm portion 22, in the direction opposite to that of the upper carriage 50, and at a slower rate of travel than the upper carriage 50 when both pistons 62 are being extended. Since the chain drive pistons 62*a*, 62*b* extend in opposing directions, the lower drive carriage 66 does not reach the bottom end of the lower arm portion 22, but the lower return roller 72 approaches that lower end. To ensure that the lower roller and its traveling shaft and wheels 68 are not pushed out the end of the lower arm portion, the lower end of the lower tracks 64 is blocked with a motion stop.

One of the pistons 62 is connected to one or both of the side supports 26*a*, 26*b*, as by rotatably connecting to a shaft extending between the side supports 26, so as to position the lower carriage 66 relative to the side supports. The upper end of the first arm portion 22 is rotatably connected to those same side supports 26. As both the pistons 62 and first arm portion 22 are connected to the same part the side supports act as a ground allowing the lower carriage to be moved along the length of the arm portion 22.

The use of hydraulic pistons 62 to vary the effective length of the chain 58, and the use of sprockets and rollers to provide a multiplying effect, thus allow the position of the upper carriage 50, grippers 40 and refuse container 42 to be controlled and to be moved a distance sufficient to have the upper carriage traverse the length of at least the first arm portion 22. While the described embodiment uses a chain drive as the preferred embodiment of the flexible, elongated drive member 58, and uses rollers 72, 76, 78, 80*a*, 80*b* to maintain the chain on a predetermined pathway, other devices could be used, including chain drives with sprockets, chain drives with combinations of sprockets and rollers, or any type of suitably flexible elongated member, including belts, ropes, cords, wire ropes, etc., and including elastomeric, ribbed drive belts used with suitable combinations of shaped sprockets, rollers and/or pulleys.

Referring to FIGS. 2-4 and 7, the orientation of the side supports 26 relative to the vertical will change depending on the angle of the lower arm portion 22, since the side supports 26 rotate about pivot axis 28. While the second arm portion 24 is always the same lateral distance from the longitudinal axis 21 when emptying the contents of the container 42, the arm portion 24 may be at a different vertical location. The side supports 26 are mounted to vertically extendable members 110 which are guided by and received in base tubes 112, preferably having a similar shape to the extendable members 110. A vertically extendable member 110 having a tubular configuration with a square cross sectional shape, telescopically sliding in a slightly larger base tube 112 with a slightly larger square cross-sectional shape are believed suitable. The vertically extendable members 110 allow the pivot points 28 to move up and down vertically, generally parallel to the side of the vehicle 12. The vertical motion of the pivot points 28 is especially useful as the support rails 30 extend laterally as it allows the triangle formed by the rails 30, lift arm 20 and extendable members to change shape as the arm 20 rotates about pivot points 28.

As the first, lower arm 22 extends outward to pick up a refuse container 42, upper end 24 of the arm rotates about pivots 28 and as the length of the lower arm 22 is fixed the lower end of the arm would normally travel a curved path. But the lower end of the lower arm 22 may be raised and lowered by telescoping the extendable support member 110 into the base 112 so as to allow the lower end of the first arm portion 22 to maintain a generally horizontal path rather than a curved path. As the first, lower arm 22 is retracted toward the vehicle 12 the second, upper end that is connected to pivot 28 may be raised by extending the support member 110 from the base 112 in order to allow the lower end of the first arm portion 22 to maintain a horizontal path. The second arm portion 24 moves with the lower arm portion 22 and support member 110. A triangle is formed by the generally vertically oriented members 110, the lower arm portion 20, and the generally horizontal oriented support rails 30, 32. The support arm 22 has a fixed length and extends between pivot 28 on vertically movable member 110 and pivot 36 on horizontally movable member 30, such that as lateral extension piston 38 (FIG. 12) moves the lower rails 30 laterally toward or away from the vehicle 12, vertically extendable members 110 are forced to slide within their bases 112 to accommodate the movement need to keep from deforming the fixed length lower arm portion 22. The ability to maintain a horizontal path by raising and lowering the pivot joint 28 connected to support member 110 allows the grippers 40 to be positioned more easily to pick up refuse containers 42.

To help the parts fit together compactly, the two extendable members 110 extend along the outward facing sides of the side supports 26*a*, 26*b*, which sides face opposing directions along axis 21. Each side support 26*a*, 26*b* is connected to a different one of the extendable members 110 by a different cantilevered pivot 28 aligned along a common axis. One end of pivot 28 is affixed to the upper distal end of extendable member 110 and the other end connects to one of the side supports 26. The pivot 28 is preferably located on an outward facing side of the side supports 26, while the pivot 96 is located on an inward facing side of the side supports 26.

The use of two opposing chain drive pistons 58 is believed to permit a faster travel of the carriage 50, gripper 40 and refuse container 42 than previously available. Motion stops at the lower end of the lower arm portion 22 prevent the wheels 60 and carriage 50 from passing out the lower end of the lower arm 22. A closed end is preferably provided on the distal end of the upper track 54 on the upper arm portion 24 at its distal, upper end. Advantageously a resilient stop member 116 (FIG. 8), such as a coil spring, is fastened to that closed end and located to abut the wheels 60 or a portion of the carriage 50 as it approaches the distal end of the second or upper arm portion 24. The cross member 90 provides a redundant stop member in addition to the closed end of the track 56.

In the prior art, the chain drive pulled the carriage over the top, curved portion of the candy-cane shaped drive path which resulted in the chain pulling the carriage downward against the end of the track but also resulted in the weight of the carriage, gripper and refuse container urging the carriage downward against the end of the track. That configuration resulted in severe shock when the carriage was brought to a stop, leading to high breakage and wear on the parts associated with the carriage, gripper and track. Slowing the drive chain down toward the end could help a little but unfavorably increased the time to pick up and dump a refuse container. Moreover, the rapid acceleration around the 180 degree curved portion of the candy-cane shaped track still led to high accelerations at the end of the track and resulted in high impact forces.

In contrast, the present design has the carriage 50 pulled by the chain 58 along the arms 22, 24 that preferably, but optionally, does not move the carriage in a downward direction until after the carriage reaches the end of the upper arm portion 24 and the end of the upper track 54. In short, the end of drive chain 58 is attached to what is the upper end of the carriage 50 when the upper arm 24 is in the first position and the chain drive pistons 62*a*, 62*b* increase the distance between rollers 72, 78 which shorten the effective length of the chain to pull the carriage against the distal end of second, upper arm 24 and stops and resilient member 116. At that point, the dump piston 98 is actuated causing the second, upper track portion 24 to rotate about a pivot axis through pivots 96, causing the carriage to rotate enough to dump the contents of the refuse container 42 into the hopper 16 of the vehicle 12. Optionally, the leveling pistons 46 may be retracted as the second arm 24 is rotated to further invert the refuse container 42. Retraction of the dump piston 98 places the first and second arm portions 22, 24 in alignment at juncture 91 and orientates the gripper 40 and refuse container 42 is more horizontal orientation. If the leveling pistons 46 were retracted as the second arm 24 was rotated then the leveling pistons 46 are returned to their initial position to place the grippers 40 generally horizontal or at a predetermined position for traveling along the length of the lower arm 22. The hydraulic chain drive pistons 62*a*, 62*b* are then retracted, causing the distance between upper and lower return sprockets 72, 78 to decrease, causing the chain 58 to move in the opposing direction and thus moving the upper carriage 50 off of the second, upper arm 24 and onto the lower arm portion 22 and toward the ground where the grippers 40 release the refuse container 42.

The second arm portion 24 does not re-curve over 180 degrees to extend in a downward direction as in the prior art candy-cane designs and instead ends at a slight upward elevation even when the lower arm 22 is extended to its maximum distance from the vehicle 12. Because the effective combined length of the arms 22, 24 are shorter than the prior art candy-cane design, and because the curved end portion 24 is oriented so the upper track 54 on which the upper carriage 50 wheels 60 rest is preferably inclined "uphill" or less preferably level and is preferably not downwardly inclined when the arms 22, 24 abut each other at junction 91. Also, because the curved portion 24 is shorter and does not extend downward to any great extent, the distance needed to move the carriage 50, gripper 40 and refuse container 42 to the distal end of the upper arm portion 24 is shorter than in the prior art. Because the oppositely oriented, hydraulic chain drive pistons 62*a*, 62*b* can achieve faster travel than conventional chain driven motors, the travel time is shortened. Because the rotation of upper arm 24 which dumps the container 42 can be very fast the cycle time for picking up, dumping and returning a trash container 42 is further reduced. Because the upper arm 24 is not re-curved with a downward extending end when the carriage 50 is being moved onto that upper arm 24, there is no need to adjust the speed of the carriage or chain 58 and thus the control system is simplified and the travel time of the carriage 50 is shortened compared to the prior art. Because the rotation of upper arm 24 occurs with the carriage 50 stationary relative to the arm portion 24 and upper track 54, the impact forces on the upper arm and track are believed to be less severe than the prior art. Because the design avoids having to move the carriage 50, gripper 40 and refuse container 42 along a large radius path at high speeds, and instead rotates those parts about a fixed pivot axis, the cycle time is shortened and the forces on the parts is reduced.

While the forces resulting from dumping by rotation about pivot 96 are believed less, the forces can still be substantial. Thus, reinforcements of the side supports 24 may be made where appropriate. Also, motion stops or motion dampers may be provided to reduce the impact of abutting parts as the second, upper arm 24 rotates to dump the contents of the trash receptacle 42. Thus, as best seen in FIGS. 7-9 and 11, resilient stop member 118 on the upper arm portion 24 may abut and aligned stop member 120 (FIG. 4) on the vehicle 12. The depicted stop members 118, 120 comprise elongated blocks of elastomeric material on a metal support that are located to abut each other when the second arm 24 is in the second, dump position. Other configurations of resilient stop members 118 may be used and other materials may be used as well.

Referring to FIGS. 7, 8 and 10, a shield or guide 122 is located at the upper end of the first arm portion 22 and extends above the upper track 54. The guide 122 has a flat sidewall and a curved flange that extends over the path traveled by the lower end of the second arm portion 24 as it rotates about pivot 96 near the abutting juncture 91. The guide 122 is located slightly outside the path to be traveled by the end of the second arm portion 24 that is lower when abutting the track 54 at juncture 91 as the arm portion 24 approaches that juncture. The guide 122 helps ensure alignment of the arm portion 24 with the lower arm portion 22 and makes access to the juncture 91 more difficult in order to enhance safety.

The side loader 10 thus has a laterally extendable first arm 22 with an upper carriage 50 connected to a gripper 40 to releasably engage refuse containers 42. The second (curved) arm 24 has a first position abutting the top end of the first arm 22 so the upper carriage 50 can reciprocate along the first and second arms, 22, 24. The second arm 24 has a second, rotated position which dumps the refuse container 14 into the hopper 16 of vehicle 12. A drive chain 58 connected to the upper carriage 50 passes over a return roller 72 which changes the direction of the chain before it is connected to the vehicle 12, preferably connecting to the first arm 22 or a side support 26. The lower carriage 66 reciprocates along the lower side of the first arm 22 and holds two oppositely directed, extendable pistons 62*a*, 62*b* (preferably hydraulic). One piston 62 moves the lower carriage 66 relative to the vehicle 12 and the other piston moves the return roller 72 to alter the effective chain length and move the upper carriage 50 faster than the lower carriage 66 while reciprocating the upper carriage 50 along the length of arms 22, 24 when the second arm 24 is in the first position.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious, modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A side loader for emptying refuse containers into a refuse collection vehicle, comprising:

an upper carriage having wheels;

a gripper mechanism having opposing grippers that are configured to open and close to release and engage a refuse container, the gripper mechanism being connected to and moving with the upper carriage;

a first arm having top and bottom ends and having a pair of spaced apart upper tracks extending between the top and bottom ends and configured to guide the wheels of the upper carriage as the carriage reciprocates along the upper tracks of the first arm, the first arm being pivotally connected to the vehicle at the top end of the first arm to rotate about a first arm pivot axis, the first arm being pivotally connected to a laterally extending rail so the bottom end of the first arm may move away from and toward the vehicle;

a second arm having opposing lower and distal ends and a pair of spaced apart upper tracks extending therebetween, the second arm having a curved portion and being pivotally mounted to the vehicle to rotate about a second arm pivot axis between a first position and second position, in the first position the lower end of the second arm is adjacent the top end of the first arm and the upper tracks on the first and second arms are sufficiently aligned and close together so the upper carriage can roll onto the upper tracks of the second arm, in the second position the second arm has rotated about the second arm pivot axis enough to dump the contents of a refuse container held by the grippers during use of the side loader;

wherein the upper rail on the second arm has a straight portion adjacent the lower end and at the distal end, with the curved portion in between.

2. The side loader of claim 1, wherein the curved portion subtends an arc that is not large enough to incline the distal end downward.

3. The side loader of claim 1, wherein the distal end is higher than the lower end of the second arm when the second arm is in the first position.

4. The side loader of claim 1, wherein a three bar linkage rotates the second arm between the first and second positions.

5. The side loader of claim 1, wherein the first arm pivots about a pair of side supports and the second arm is pivotally connected to those side supports.

6. The side loader of claim 1, further comprising drive means configured to reciprocate the upper carriage along the first and second arms.

7. The side loader of claim 1, wherein the first arm further comprises a divider extending between the opposing upper rails on the first arm and extending a majority of a length of the first arm, the divider connecting to a lower side of the upper rails on the first arm and having a center portion between the upper rails that extends outward beyond that lower side of the upper rails.

8. The side loader of claim 1, further comprising:

a lower carriage having wheels; and a pair of spaced apart, lower tracks extending a majority of the length of the first arm and located on a bottom side of the first arm, the lower tracks configured to guide the wheels of the lower carriage as the lower carriage reciprocates along the lower tracks of the first arm.

9. The side loader of claim 8, further comprising:

first and second extendable drive pistons connected to the lower carriage and aligned to extend in opposing directions along the length of the first arm, the first drive piston having an extendable end that is connected to a positionable shaft configured to move along a second length of the lower tracks as the second piston extends and retracts, the second drive piston having an extendable end that is pivotably connected to the vehicle during use to reciprocate the carriage along a first length of the lower tracks as the first drive piston extends and retracts; and a flexible, elongated drive member having a first end connected to the upper carriage and a second end connected to the vehicle, the elongated drive member passing over at least two rotating parts which reverse the direction of the elongated drive member so that extension and retraction of the first and second chain drive pistons move the lower carriage a total distance X and cause the second upper carriage to move a distance greater than X.

10. The side loader of claim 9, wherein the elongated drive member passes over at lease a first rotating part at the top end of the second arm which reverses the direction of the elongated drive member and further passes over a second return rotating part on the positionable shaft to also reverse the direction of the elongated drive member so that extension and retraction of the first and second chain drive pistons a total distance X causes the second return rotating part to move a total distance X and the upper carriage to move a distance greater than X.

11. The side loader of claim 9, wherein the first and second drive pistons comprise hydraulic pistons.

12. The side loader of claim 10, wherein the positionable shaft comprises a shaft having wheels configured to reciprocate along the lower tracks and wherein the first length extends along a top portion of the first arm and the second length extends along a bottom portion of the first arm.

13. The side loader of claim 9, wherein the first and second drive pistons comprise hydraulic pistons and the elongated drive member comprises a chain.

14. The side loader of claim 8, further comprising:

a divider extending between the opposing upper rails on the first arm and extending a majority of a length of the first arm, the divider connecting to a lower side of the upper rails on the first arm and having a center portion that extends outward beyond than that lower side;

first and second extendable drive pistons connected to the lower carriage and aligned to extend in opposing directions along the length of the first arm, the second drive piston having an extendable end that is connected to a positionable shaft having wheels configured to move along a second length of the lower tracks as the second piston extends and retracts, the first drive piston having an extendable end that is pivotably connected to the vehicle during use to reciprocate the carriage along a first length of the lower tracks as the first drive piston extends and retracts, at least a portion of the drive pistons located within a bottom side of the outwardly extending portion of the divider; and a flexible, elongated drive member having a first end connected to the upper carriage and a second end connected to the vehicle, the elongated drive member passing over a first rotating part at the top end of the first arm and a return rotating part on the second arm which reverses the direction of the elongated member and a second return rotating part on the positionable shaft which reverses the direction of the elongated member and so that extension and retraction of the first and second chain drive pistons to move the lower carriage a distance X causes the upper carriage to move a distance greater than X.

15. A mechanism for moving a gripper mechanism reciprocating along an arm connected to a refuse collection vehicle, the gripper mechanism having arms configured to releasably grip a refuse container, the arm having a lower end extending toward and away from the vehicle during use and having an upper end sufficiently above a portion of the vehicle to allow the refuse container to be dumped into the vehicle, the mechanism comprising:

a first gripper carriage to which the gripper mechanism is connected, the first carriage configured to reciprocate along a length of the arm sufficient to enable the a gripper to pick up, dump and set down refuse containers;

a second piston carriage mounted to reciprocate along a length of the arm, the piston carriage having first and second carriage pistons each aligned to extend along a length of the arm but in opposing directions, the first carriage piston having a distal end connected to a first rotating part mounted to move along a length of the arm, the second carriage piston having a distal end connected to the vehicle at a fixed location;

a flexible, elongated drive member having a first end connected to the first gripper carriage and a second end connected to the vehicle at a fixed location, the chain extending from the first gripper carriage, over a second rotating part at the upper end of the arm where the elongated drive member reverses directions and extends past the piston carriage and around the first movable part where the elongated drive member reverses direction and extends past the piston carriage to the second end of the elongated drive member, such that a change in length of one carriage piston a distance X moves the first gripper carriage a distance X and a change in length of both carriage pistons a distance X moves the first gripper carriage a distance 2X.

16. The mechanism of claim 15, wherein the first and second carriages are on opposing sides of the arm.

17. The mechanism of claim 15, wherein the first and second carriages move along the arm in opposing directions.

18. The mechanism of claim 15, wherein the first and second carriages are each mounted to rotatable wheels to facilitate the reciprocating motion.

19. The mechanism of claim 15, wherein the arm has an upper and lower segment with the upper segment rotatablely mounted to rotate about a generally horizontal axis to rotate the first gripper carriage to a dump position.

20. A side loader for emptying refuse containers into a refuse collection vehicle using an arm extendable from the vehicle and along which a carriage connected to a gripper mechanism reciprocates to pick up and empty the refuse containers, comprising:

a two part arm along which an upper carriage reciprocates, the arm including a lower arm portion and an upper arm portion, the upper portion rotatable about an axis between a first position and second position, the first position aligned with the lower arm portion so the upper carriage can move between the first and second arm portions, the second position being rotated about a generally horizontal axis transverse to the lower arm and rotated sufficiently to dump the contents of the refuse container into the vehicle at a predetermined location during use; and a lower carriage reciprocating along the first portion on a side of the first portion of the arm opposite the upper carriage, the lower carriage having mounted thereon two carriage drive pistons oriented to extend and retract in opposing directions along the length of the lower arm portion, a first one of the carriage drive pistons connected to a first rotating part about which a flexible, elongated drive member extends to reverse the direction of travel of the elongated drive member and to change an effective length of the elongated drive member and to move the upper carriage to which one end of the elongated drive member is connected as the first drive piston extends or retracts.

21. The side loader of claim 20, further comprising a second rotating part about which the flexible, elongated drive member extends to reverse the direction of travel of the elongated drive member.

22. A method for moving a gripper mechanism along an arm connected to a refuse collection vehicle, the gripper mechanism having arms configured to releasably grip a refuse container, the arm having a lower end extending toward and away from the vehicle during use and having an upper end sufficiently above a portion of the vehicle to allow the refuse container to be dumped into the vehicle, the method comprising the steps of:

moving a first carriage to which a gripper for a refuse container is mounted, along the arm in a first direction;

moving a second carriage along the arm in a second direction opposite to the first direction using first and second extendable pistons connected to the second carriage, the first piston having one end connected to the vehicle to move the second carriage along the arm as the first piston extends and retracts, the second piston connected to a first rotating part around which an elongated flexible member extends to reverse the direction of the flexible member and to also change the distance between the first rotating part and the second carriage as the second carriage piston extends and retracts, the elongated member extending around a second rotating part to reverse the direction of the elongated member before that elongated member connects to the first carriage, the elongated member having a second end connected to the vehicle.

23. The method of claim 22, wherein the step of moving the first carriage further comprises moving the first carriage along a first track connected to the arm and wherein the step of moving the second carriage further comprises moving the second carriage along a second track connected to the arm.

24. The method of claim 23, wherein the steps of moving the first and second carriage comprise moving the second carriage further than the distance the first carriage moves.

25. The method of claim 23, wherein the steps of moving the first and second carriage comprise moving the second carriage twice the distance the first carriage moves.

26. The method of claim 23, comprising the further step of rotating an upper end portion of the first track when the first carriage is located on that upper end portion, the rotation being in a direction to dump a refuse container held by the gripping mechanism, into the refuse collection vehicle.

27. The method of claim 26, wherein the end portion of the first track has a curved portion.

28. A side loader for emptying refuse containers into a refuse collection vehicle, comprising an upper carriage having wheels;

a gripper mechanism having opposing grippers that are configured to open and close to release and engage a refuse container, the gripper mechanism being connected to and moving with the upper carriage;

a first arm having top and bottom ends and having a pair of spaced apart upper tracks extending between the top and bottom ends and configured to guide the wheels of the upper carriage as the carriage reciprocates along the upper tracks of the first arm, the first arm being pivotally connected to the vehicle at the top end of the first arm to rotate about a first arm pivot axis, the first arm being pivotally connected to a laterally extending rail so the bottom end of the first arm may move away from and toward the vehicle;

a second arm having opposing lower and distal ends and a pair of spaced apart upper tracks extending therebetween, the second arm having a curved portion and being pivotally mounted to the vehicle to rotate about a second arm pivot axis between a first position and second position, in the first position the lower end of the second arm is adjacent the top end of the first arm and the upper tracks on the first and second arms are sufficiently aligned and close together so the upper carriage can roll onto the upper tracks of the second arm, in the second position the second arm has rotated about the second arm pivot axis enough to dump the contents of a refuse container held by the grippers during use of the side loader;

a lower carriage having wheels; and a pair of spaced apart, lower tracks extending a majority of the length of the first arm and located on a bottom side of the first arm, the lower tracks configured to guide the wheels of the lower carriage as the lower carriage reciprocates along the lower tracks of the first arm;

first and second extendable drive pistons connected to the lower carriage and aligned to extend in opposing directions along the length of the first arm, the first drive piston having an extendable end that is connected to a positionable shaft configured to move along a second length of the lower tracks as the second piston extends and retracts, the second drive piston having an extendable end that is pivotably connected to the vehicle during use to reciprocate the carriage along a first length of the lower tracks as the first drive piston extends and retracts; and a flexible, elongated drive member having a first end connected to the upper carriage and a second end connected to the vehicle, the elongated drive member passing over at least two rotating parts which reverse the direction of the elongated drive member so that extension and retraction of the first and second chain drive pistons move the lower carriage a total distance X and cause the second upper carriage to move a distance greater than X.

29. The side loader of claim 28, wherein the elongated drive member passes over at lease a first rotating part at the top end of the second arm which reverses the direction of the elongated drive member and further passes over a second return rotating part on the positionable shaft to also reverse the direction of the elongated drive member so that extension and retraction of the first and second chain drive pistons a total distance X causes the second return rotating part to move a total distance X and the upper carriage to move a distance greater than X.

30. The side loader of claim 28, wherein the flexible, elongated drive member further passes over a distal rotating part connected to the second arm to reverse the direction of the elongated drive member.

31. The side loader of claim 28, wherein the first and second drive pistons comprise hydraulic pistons.

32. The side loader of claim 29, wherein the positionable shaft comprises a shaft having wheels configured to reciprocate along the lower tracks and wherein the first length extends along a top portion of the first arm and the second length extends along a bottom portion of the first arm.

33. The side loader of claim 28, wherein the first and second drive pistons comprise hydraulic pistons and the elongated drive member comprises a chain.

34. The side loader of claim 28, wherein the flexible, elongated drive member further passes over a distal rotating part connected to the second arm to reverse the direction of the elongated drive member.

35. A side loader for emptying refuse containers into a refuse collection vehicle, comprising:

an upper carriage having wheels;

a gripper mechanism having opposing grippers that are configured to open and close to release and engage a refuse container, the gripper mechanism being connected to and moving with the upper carriage;

a first arm having top and bottom ends and having a pair of spaced apart upper tracks extending between the top and bottom ends and configured to guide the wheels of the upper carriage as the carriage reciprocates along the upper tracks of the first arm, the first arm being pivotally connected to the vehicle at the top end of the first arm to rotate about a first arm pivot axis, the first arm being pivotally connected to a laterally extending rail so the bottom end of the first arm may move away from and toward the vehicle;

a second arm having opposing lower and distal ends and a pair of spaced apart upper tracks extending therebetween, the second arm having a curved portion and being pivotally mounted to the vehicle to rotate about a second arm pivot axis between a first position and second position, in the first position the lower end of the second arm is adjacent the top end of the first arm and the upper tracks on the first and second arms are sufficiently aligned and close together so the upper carriage can roll onto the upper tracks of the second arm, in the second position the second arm has rotated about the second arm pivot axis enough to dump the contents of a refuse container held by the grippers during use of the side load;

a lower carriage having wheels; and a pair of spaced apart, lower tracks extending a majority of the length of the first arm and located on a bottom side of the first arm, the lower tracks configured to guide the wheels of the lower carriage as the lower carriage reciprocates along the lower tracks of the first arm;

a divider extending between the opposing upper rails on the first arm and extending a majority of a length of the first arm, the divider connecting to a lower side of the upper rails on the first arm and having a center portion that extends outward beyond than that lower side;

first and second extendable drive pistons connected to the lower carriage and aligned to extend in opposing directions along the length of the first arm, the second drive piston having an extendable end that is connected to a positionable shaft having wheels configured to move along a second length of the lower tracks as the second piston extends and retracts, the first drive piston having an extendable end that is pivotably connected to the vehicle during use to reciprocate the carriage along a first length of the lower tracks as the first drive piston extends and retracts, at least a portion of the drive pistons located within a bottom side of the outwardly extending portion of the divider; and a flexible, elongated drive member having a first end connected to the upper carriage and a second end connected to the vehicle, the elongated drive member passing over a first rotating part at the top end of the first arm and a return rotating part on the second arm which reverses the direction of the elongated member and a second return rotating part on the positionable shaft which reverses the direction of the elongated member and so that extension and retraction of the first and second chain drive pistons to move the lower carriage a distance X causes the upper carriage to move a distance greater than X.

* * * * *